US007955775B2

(12) United States Patent
Shinohara et al.

(10) Patent No.: US 7,955,775 B2
(45) Date of Patent: Jun. 7, 2011

(54) IMAGE-FORMING METHOD USING HEAT-SENSITIVE TRANSFER SYSTEM

(75) Inventors: Ryuji Shinohara, Minami-ashigara (JP); Yoshihiko Fujie, Minami-ashigara (JP); Yoshihisa Tsukada, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/715,875

(22) Filed: Mar. 9, 2007

(65) Prior Publication Data

US 2007/0212636 A1 Sep. 13, 2007

(30) Foreign Application Priority Data

Mar. 10, 2006 (JP) ..... 2006-065180

(51) Int. Cl.
*G03C 8/00* (2006.01)
*B41M 5/00* (2006.01)

(52) U.S. Cl. ..... 430/201; 428/32.6; 428/32.64; 428/32.39; 428/32.85; 428/32.86; 503/227

(58) Field of Classification Search ..... 428/32.39, 428/32.6, 32.64, 32.85, 32.86; 430/201; 503/227

See application file for complete search history.

(56) References Cited

U.S. PATENT DOCUMENTS

| | | | | |
|---|---|---|---|---|
| 4,866,029 | A * | 9/1989 | Evans et al. | 503/227 |
| 5,071,823 | A * | 12/1991 | Matsushita et al. | 503/227 |
| 5,270,284 | A * | 12/1993 | Kanto et al. | 503/227 |
| 5,302,574 | A * | 4/1994 | Lawrence et al. | 503/227 |
| 5,529,972 | A * | 6/1996 | Ramello et al. | 503/227 |
| 5,916,842 | A * | 6/1999 | Morimitsu et al. | 503/227 |
| 7,223,513 | B2 * | 5/2007 | Nakane et al. | 430/200 |
| 7,329,632 | B2 * | 2/2008 | Ishida | 503/227 |
| 7,485,402 | B2 * | 2/2009 | Arai et al. | 430/201 |
| 2007/0203024 | A1 * | 8/2007 | Takehara et al. | 503/227 |

FOREIGN PATENT DOCUMENTS

| | | | |
|---|---|---|---|
| JP | 6-19033 | | 3/1994 |
| JP | 10-864 | A | 1/1998 |
| JP | 10-181223 | A | 7/1998 |
| JP | 10-305665 | | 11/1998 |
| JP | 2000-238440 | A | 9/2000 |
| JP | 02004230878 | * | 8/2004 |
| JP | 2005-297451 | A | 10/2005 |

* cited by examiner

*Primary Examiner* — Thorl Chea
(74) *Attorney, Agent, or Firm* — Sughrue Mion, PLLC

(57) ABSTRACT

An image-forming method: by superposing a heat-sensitive transfer sheet on a heat-sensitive transfer image-receiving sheet so that a receptor layer can be contacted with a thermal transfer layer; and providing thermal energy in accordance with image signals;

in which the heat-sensitive transfer image-receiving sheet comprises the receptor layer containing one of polyester and/or polycarbonate polymers, vinyl chloride polymers and/or a polymer latex; and in which the heat-sensitive transfer sheet comprises the thermal transfer layer containing a dye represented by formula (1) or (2):

Formula (1)

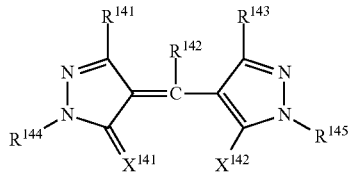

Formula (2)

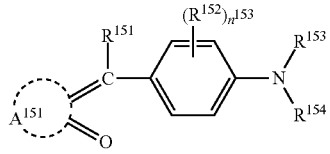

wherein, $X^{141}$ represents an oxygen atom, a sulfur atom, or $NR^{146}$; $X^{142}$ represents a hydroxyl group, a mercapto group, or $NHR^{147}$; $R^{141}$ to $R^{154}$ each represent a hydrogen atom or a substituent; $A^{151}$ represents a group of atoms necessary to form a hetero ring together with the two carbon atoms; and $n^{153}$ represents an integer of 0 to 4.

25 Claims, No Drawings

IMAGE-FORMING METHOD USING HEAT-SENSITIVE TRANSFER SYSTEM

FIELD OF THE INVENTION

The present invention relates to an image-forming method using a heat-sensitive (thermal) transfer system. Particularly, the present invention relates to an image-forming method that is excellent in absorption characteristics and fastness of images.

BACKGROUND OF THE INVENTION

Various heat transfer recording methods have been known so far. Among these methods, dye diffusion transfer recording systems attract attention as a process that can produce a color hard copy having an image quality closest to that of silver salt photography (see, for example, "Joho Kiroku (Hard Copy) to Sono Zairyo no Shintenkai (Information Recording (Hard Copy) and New Development of Recording Materials)" published by Toray Research Center Inc., 1993, pp. 241-285; and "Printer Zairyo no Kaihatsu (Development of Printer Materials)" published by CMC Publishing Co., Ltd., 1995, p. 180). Moreover, this system has advantages over silver salt photography: it is a dry system, it enables direct visualization from digital data, it makes reproduction simple, and the like.

In this dye diffusion transfer recording system, a heat-sensitive (thermal) transfer sheet (hereinafter also referred to as an ink sheet) containing dyes is superposed on a heat-sensitive (thermal) transfer image-receiving sheet (hereinafter also referred to as an image-receiving sheet), and then the heat-sensitive transfer sheet is heated by a thermal head whose exothermic action is controlled by electric signals, in order to transfer the dyes contained in the heat-sensitive transfer sheet to the image-receiving sheet, thereby recording an image information. Three colors: cyan, magenta, and yellow, are used for recording a color image by overlapping one color to other, thereby enabling transferring and recording a color image having continuous gradation for color densities.

Examples of the properties of the heat-sensitive transfer sheet and the heat-sensitive transfer image-receiving sheet necessary for such an image-forming method include: performance of spectral characteristics desired in color reproduction; easy transfer; fastness to light and heat; resistance to various chemicals; easy synthesis; and being easy to prepare the heat-sensitive transfer sheet and the heat-sensitive transfer image-receiving sheet. In this image-forming method, a dye left on the heat-sensitive transfer sheet after image-recording is not used. Accordingly, it has been desired to develop a dye showing a high transferring rate from the heat-sensitive transfer sheet to the heat-sensitive transfer image-receiving sheet at the time of heating with a thermal head.

JP-B-6-19033 ("JP-B" means examined Japanese patent publication) discloses specific pyrazolone-series dyes, and JP-A-10-305665 ("JP-A" means unexamined published Japanese patent application) discloses specific bispyrazolone methane-series dyes. However, these publications do not disclose any such dye-transferring that can enhance by employing any dye and a specific image-receiving layer in the image-forming method using the thermal transfer system, at all.

SUMMARY OF THE INVENTION

The present invention resides in an image-forming method comprising the steps of:

superposing a heat-sensitive transfer sheet on a heat-sensitive transfer image-receiving sheet so that at least one receptor layer of the heat-sensitive transfer image-receiving sheet described below can be contacted with a thermal transfer layer of the heat-sensitive transfer sheet described below; and providing thermal energy in accordance with image signals from a thermal head, thereby to form an image;

(i) wherein the heat-sensitive transfer image-receiving sheet comprises, on a support, said at least one receptor layer that contains at least one polymer selected from the group consisting of (a) polyester and/or polycarbonate polymers, (b) vinyl chloride polymers and (c) a polymer latex; and (ii) wherein the heat-sensitive transfer sheet comprises, on a support, said thermal transfer layer that contains a dye represented by formula (1) or (2):

Formula (1)

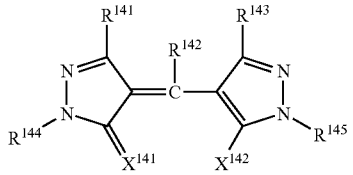

wherein, in formula (1), $X^{141}$ represents an oxygen atom, a sulfur atom, or $NR^{146}$; $X^{142}$ represents a hydroxyl group, a mercapto group, or $NHR^{147}$; and $R^{141}$, $R^{142}$, $R^{143}$, $R^{144}$, $R^{145}$, $R^{146}$ and $R^{147}$ each independently represent a hydrogen atom or a monovalent substituent; and Formula (2)

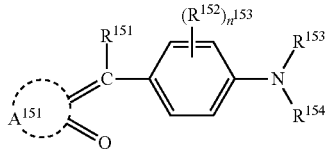

wherein, in formula (2), $R^{151}$, $R^{153}$ and $R^{154}$ each independently represent a hydrogen atom or a monovalent substituent; $R^{152}$ represents a monovalent substituent; $A^{151}$ represents a group of atoms necessary to form a hetero ring together with the two carbon atoms; and $n^{153}$ represents an integer of 0 to 4.

Other and further features and advantages of the invention will appear more fully from the following description.

DETAILED DESCRIPTION OF THE INVENTION

According to the present invention, there is provided the following means:

(1) An image-forming method comprising the steps of:

superposing a heat-sensitive transfer sheet on a heat-sensitive transfer image-receiving sheet so that at least one receptor layer of the heat-sensitive transfer image-receiving sheet described below can be contacted with a thermal transfer layer of the heat-sensitive transfer sheet described below; and providing thermal energy in accordance with image signals from a thermal head, thereby to form an image;

(i) wherein the heat-sensitive transfer image-receiving sheet comprises, on a support, said at least one receptor layer that contains at least one polymer selected from the group consisting of (a) polyester and/or polycarbonate polymers, (b) vinyl chloride polymers and (c) a polymer latex; and (ii) wherein the heat-sensitive transfer sheet comprises, on a support, said thermal transfer layer that contains a dye represented by formula (1):

Formula (1)

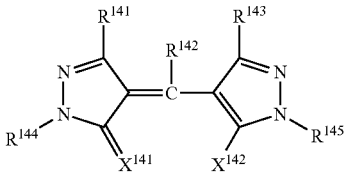

wherein $X^{141}$ represents an oxygen atom, a sulfur atom, or $NR^{146}$; $X^{142}$ represents a hydroxyl group, a mercapto group, or $NHR^{147}$; and $R^{141}$, $R^{142}$, $R^{143}$, $R^{144}$, $R^{145}$, $R^{146}$ and $R^{147}$ each independently represent a hydrogen atom or a monovalent substituent;

(2) An image-forming method comprising the steps of:

superposing a heat-sensitive transfer sheet on a heat-sensitive transfer image-receiving sheet so that at least one receptor layer of the heat-sensitive transfer image-receiving sheet described below can be contacted with a thermal transfer layer of the heat-sensitive transfer sheet described below; and providing thermal energy in accordance with image signals from a thermal head, thereby to form an image;

(i) wherein the heat-sensitive transfer image-receiving sheet comprises, on a support, said at least one receptor layer that contains at least one polymer selected from the group consisting of (a) polyester and/or polycarbonate polymers, (b) vinyl chloride polymers and (c) a polymer latex; and (ii) wherein the heat-sensitive transfer sheet comprises, on a support, said thermal transfer layer that contains a dye represented by formula (2):

Formula (2)

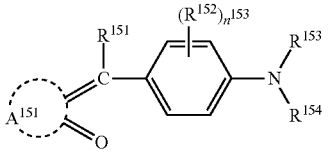

wherein $R^{151}$, $R^{153}$ and $R^{154}$ each independently represent a hydrogen atom or a monovalent substituent; $R^{152}$ represents a monovalent substituent; $A^{151}$ represents a group of atoms necessary to form a hetero ring together with the two carbon atoms; and $n^{153}$ represents an integer of 0 to 4;

(3) The image-forming method described in the above item (1) or (2), wherein the polymer contained in the receptor layer is the (a) polyester and/or polycarbonate polymers;

(4) The image-forming method described in the above item (1) or (2), wherein the polymer contained in the receptor layer is the (b) vinyl chloride polymers;

(5) The image-forming method described in the above item (1) or (2), wherein the polymer contained in the receptor layer is the (c) polymer latex;

(6) The image-forming method described in the above item (5), wherein the (c) polymer latex is a vinyl chloride-series polymer latex;

(7) The image-forming method described in any one of the above items (1) to (6), wherein the above-described heat-sensitive transfer image-receiving sheet has an interlayer containing hollow particles between the support and the receptor layer; and (8) The image-forming method described in the above item (7), wherein the above-described interlayer of the heat-sensitive transfer image-receiving sheet contains a water-soluble polymer.

The image-forming method using a thermal transfer process according to the present invention is explained in detail below.

The following explanation of constituent elements is sometimes based on representative embodiments of the present invention. However, the present invention should not be construed as being limited to such embodiments. In the present specification, the word "to" showing ranges between two numerical values is used to include these numerical values as lower and upper limits of the ranges.

The term "monovalent substituent" used in this specification is not limited in particular. Representative examples thereof include a halogen atom, an alkyl group (the term "alkyl group" used in this specification means a saturated aliphatic group including a cycloalkyl group and a bicycloalkyl group), an alkenyl group (the term "alkenyl group" used in this specification means an unsaturated aliphatic group having a double bond, that includes a cycloalkenyl group and a bicycloalkenyl group), an alkynyl group, an aryl group, a heterocyclic group, a cyano group, an alkoxy group, an aryloxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkyl- or aryl-sulfonylamino group, an alkylthio group, a sulfamoyl group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, and an imido group. Each of the above-described groups may be further substituted.

The term "acidic nucleus" described in this specification has the same meanings as defined in James, "The Theory of the Photographic Process", Forth Edition, Macmillan (1977), page 198, and F. M. Harmer, "Heterocyclic Compounds—Cyanine Dyes and Related Compounds", John & Wiley & Sons, New York, London (1964). Representative examples thereof include 2-pyrazoline-5-on, pyrazolidine-3,5-dion, imidazoline-5-on, hydantoin, 2- or 4-thiohydantoin, 2-iminooxazolidine-4-on, 2-oxazoline-5-on, 2-thiooxazoline-2,4-dion, isorhodanine, rhodanine, indane-1,3-dion, thiophene-3-on, thiophene-3-on-1,1-dioxide, indoline-2-on, indoline-3-on, 2-oxoindazolium, 5,7-dioxo-6,7-dihydrothiazolo[3,2-a]pyrimidine, 3,4-dihydroisoquinoline-4-on, 1,3-dioxane-4,6-dion, barbituric acid, 2-thiobarbituric acid, coumarin-2,4-dion, indazoline-2-on, pyrido[1,2-a]pyrimidine-1,3-dion, pyrazolo[1,5-b]quinazolone, pyrazolopyridone, 3-dicyanomethylidenyl-3-phenylpropionitrile, and Meldrum's acid. Each of these nuclei may be further substituted.

First, the dye having a structure represented by formula (1) is explained in detail.

Formula (1)

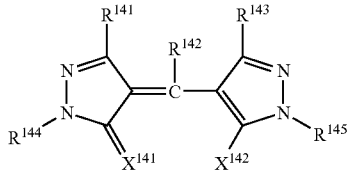

In formula (1), $X^{141}$ represents an oxygen atom, a sulfur atom, or $NR^{146}$. $X^{142}$ represents a hydroxyl group, a mercapto group, or $NHR^{147}$. $R^{141}$, $R^{142}$, $R^{143}$, $R^{144}$, $R^{145}$, $R^{146}$ and $R^{147}$ each independently represent a hydrogen atom or a monovalent substituent. When $X^{141}$ is $NR^{146}$ group, $NR^{146}$ may bond to $R^{144}$ to form a 5- or 6-membered ring. When $X^{142}$ is $NHR^{147}$, $NHR^{147}$ may bond to $R^{145}$ to form a 5- or 6-membered ring.

$X^{141}$ is preferably an oxygen atom or $NR^{146}$, and more preferably an oxygen atom.

$X^{142}$ is preferably a hydroxyl group or $NHR^{147}$, and more preferably a hydroxyl group.

$R^{141}$ and $R^{143}$ each independently preferably represent a hydrogen atom, a substituted or unsubstituted alkyl group, a substituted or unsubstituted alkenyl group, a substituted or unsubstituted aryl group, a substituted or unsubstituted heterocyclic group, a substituted or unsubstituted amino group, a substituted or unsubstituted acylamino group, a substituted or unsubstituted alkoxy group, a substituted or unsubstituted alkoxycarbonyl group, a substituted or unsubstituted aryloxycarbonyl group, a cyano group, a carbamoyl group or a carboxyl group; more preferably a substituted or unsubstituted alkyl group, a substituted or unsubstituted aryl group, a substituted or unsubstituted amino group, a substituted or unsubstituted alkoxy group, a cyano group or a carbamoyl group; and most preferably a substituted or unsubstituted alkyl group.

$R^{142}$ preferably represents a hydrogen atom, a substituted or unsubstituted alkyl group, or a cyano group; more preferably a hydrogen atom or a substituted or unsubstituted alkyl group; and most preferably a hydrogen atom.

$R^{144}$ and $R^{145}$ each independently preferably represent a hydrogen atom, a substituted or unsubstituted alkyl group, a substituted or unsubstituted alkenyl group, a substituted or unsubstituted aryl group, or a substituted or unsubstituted heterocyclic group; and more preferably a substituted or unsubstituted alkyl group or a substituted or unsubstituted aryl group.

$R^{146}$ and $R^{147}$ each independently preferably represent a hydrogen atom, a substituted or unsubstituted alkyl group, or an imino group. Alternatively, $R^{144}$ and $R^{146}$ and/or $R^{145}$ and $R^{147}$ may bond together to form a 5- or 6-membered hetero ring.

The following is an explanation about a preferable combination of various substituents (atoms) that a dye represented by formula (1) may have: A preferred dye is a dye in which at least one of the substituents is the above-described preferable substituent. A more preferred dye is a dye in which many various substituents are the above-described preferable substituents. The most preferred dye is a dye in which all substituents are the above-described preferable substituents.

For the combination of the substituents, it is preferable that $X^{141}$ is an oxygen atom, $X^{142}$ is a hydroxyl group, $R^{141}$ and $R^{143}$ each are a substituted or unsubstituted alkyl group having 1 to 6 carbon atoms, $R^{142}$ is a hydrogen atom, and $R^{144}$ and $R^{145}$ each are a substituted or unsubstituted aryl group.

The dye represented by formula (2) is explained in detail.

Formula (2)

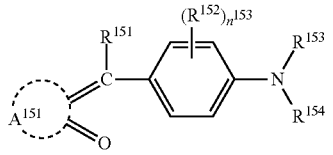

In formula (2), $R^{151}$, $R^{153}$ and $R^{154}$ each independently represent a hydrogen atom or a monovalent substituent. $R^{152}$ represents a monovalent substituent. $A^{151}$ represents a group of atoms necessary to form a hetero ring together with the two carbon atoms. $n^{153}$ represents an integer of 0 to 4.

$R^{151}$ preferably represents a hydrogen atom, or a substituted or unsubstituted alkyl group having 1 to 6 carbon atoms; and more preferably a hydrogen atom.

$R^{152}$ preferably represents a substituted or unsubstituted alkyl group having 1 to 6 carbon atoms, a substituted or unsubstituted alkoxy group having 1 to 6 carbon atoms, or a halogen atom.

$R^{153}$ and $R^{154}$ each independently represent a hydrogen atom, a substituted or unsubstituted alkyl group, a substituted or unsubstituted alkenyl group, a substituted or unsubstituted aryl group, or a substituted or unsubstituted heterocyclic group; more preferably a hydrogen atom, or a substituted or unsubstituted alkyl group having 1 to 6 carbon atoms.

$A^{151}$ is preferably a group of atoms necessary to form an acidic nucleus together with the two (2) carbon atoms. The acidic nucleus is preferably a substituted or unsubstituted 2-pyrazoline-5-on.

$n^{153}$ is preferably an integer of 0 to 2, and more preferably an integer of 0 to 1.

The following is an explanation about a preferable combination of various substituents (atoms) that a dye represented by formula (2) may have: A preferred dye is a dye in which at least one of the substituents is the above-described preferable substituent. A more preferred dye is a dye in which many various substituents are the above-described preferable substituents. The most preferred dye is a dye in which all substituents are the above-described preferable substituents.

For the combination of the substituents, it is preferable that $A^{151}$ is a group of atoms necessary to form a substituted 2-pyrazoline-5-on, $R^{151}$ is a hydrogen atom, $R^{152}$ is a substituted or unsubstituted alkyl group having 1 to 6 carbon atoms or a substituted or unsubstituted alkoxy group having 1 to 6 carbon atoms, $R^{153}$ is a substituted or unsubstituted alkyl group having 1 to 6 carbon atoms, $R^{154}$ is a substituted or unsubstituted alkyl group having 1 to 6 carbon atoms, and $n^{153}$ is an integer of 0 to 2; and more preferable that $A^{151}$ is a group of atoms necessary to form a 3-alkoxy-2-pyrazoline-5-on having a substituent(s), $R^{151}$ is a hydrogen atom, $R^{152}$ is a substituted or unsubstituted alkyl group having 1 to 6 carbon atoms or a substituted or unsubstituted alkoxy group having 1 to 6 carbon atoms, $R^{153}$ is a substituted or unsubstituted alkyl group having 1 to 6 carbon atoms, $R^{154}$ is a substituted or unsubstituted alkyl group having 1 to 6 carbon atoms, and $n^{153}$ is an integer of 0 to 1.

A molecular weight of the dye represented by formula (1) or (2) is preferably 500 or less, and more preferably 450 or less; from a viewpoint of thermal diffusion.

Specific examples of the dye represented by formula (1) or (2) are set forth below. However, the dye used in the present invention should not be construed as being limited to these specific examples. Herein, "Ph" in these specific examples means a phenyl group ($—C_6H_5$).

(1)-1

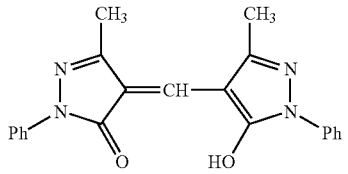

-continued (1)-2

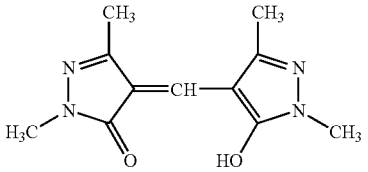

(1)-3

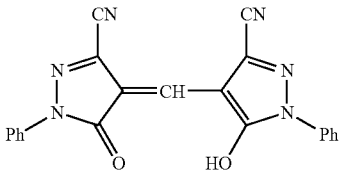

(1)-4

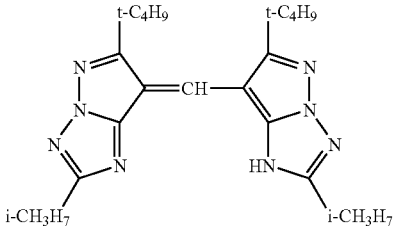

(2)-1

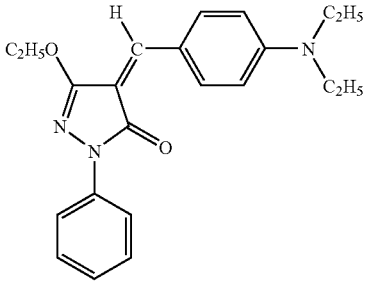

(2)-2

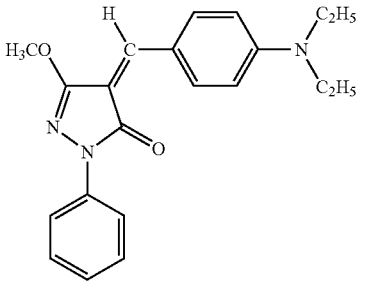

(2)-3

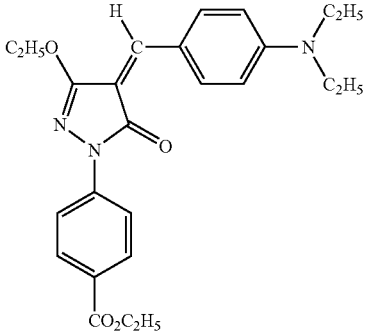

The dye represented by formula (1) or (2) can be synthesized by or referring to the method described in, for example, JP-B-6-19033 and JP-A-10-305665.

The maximum absorption wavelength of absorption spectrum of each of the exemplified compound (1)-1, (1)-2 and (1)-3 in an ethyl acetate solution is shown in Table 1.

TABLE 1

| Dye | Maximum absorption wavelength (nm) |
|---|---|
| (1)-1 | 398 |
| (1)-2 | 409 |
| (1)-3 | 393 |

(1) Heat-Sensitive Transfer Sheet

The heat-sensitive transfer sheet used in the image-forming method of the present invention has, on a support, a thermal transfer layer containing the dye represented by formula (1) or (2). The thermal transfer layer can be formed by dissolving the dye with a binder in a solvent or dispersing the dye in a medium as fine particles to thereby prepare an ink solution, applying the ink solution to a support, and suitably drying the ink. With respect to the binder resin, ink medium, support, and image-receiving sheet to be used, ones described in, for example, JP-A-7-137466 can be preferably used.

In order to use the above heat-sensitive transfer recording material as a heat-sensitive transfer recording material capable of recording a full-color image, it is preferred that a cyan ink sheet containing a thermally diffusible cyan dye which can form a cyan image, a magenta ink sheet containing a thermally diffusible magenta dye which can form a magenta image, and a yellow ink sheet containing a thermally diffusible yellow dye which can form a yellow image be formed on a support by applying sequentially. It is preferable that a protective layer for the transfer portion is further provided. In addition, an ink sheet containing a black-image-forming substance may be further provided as required.

Each of these dyes is preferably contained in the thermal transfer layer (dye layer) in an amount of 10 to 90% by mass, and more preferably 20 to 80% by mass.

The dye layer is applied using a usual method such as a roll coating, a bar coating, a gravure coating, and a gravure reverse coating. A coating amount of the thermal transfer layer is preferably in the range of 0.1 to 1.0 g/m$^2$ (in solid content equivalent), and more preferably in the range of 0.15 to 0.60 g/m$^2$. Hereinafter, the term "coating amount" used herein is expressed by a solid content equivalent value, unless it is indicated differently in particular. A film thickness of the thermal transfer layer is preferably in the range of 0.1 to 2.0 μm, and more preferably in the range of 0.1 to 1.0 μm.

As a support for the heat-sensitive transfer sheet, use may be made of the same as those for use in the heat-sensitive transfer image-receiving sheet described below, for example, polyethyleneterephthalate.

A thickness of the support is preferably in the range of 1 to 10 μm, and more preferably in the range of 2 to 8 μm.

With respect to the heat-sensitive transfer sheet, there is a detailed explanation in, for example, paragraph Nos. 0017 to 0078 of JP-A-11-105437. The explanation may be preferably incorporated by reference into the specification of the present application.

(2) Heat-Sensitive Transfer Image-Receiving Sheet

Next, the heat-sensitive transfer image-receiving sheet (image-receiving sheet) used in the image-forming method of the present invention is described below.

The heat-sensitive transfer image-receiving sheet used in the present invention is provided with a dye-receiving layer (receptor layer) formed on a support. It is preferable to form an undercoat layer between the receptor layer and the support.

As the undercoat layer, for example, a white background control layer, a charge control layer, an adhesive layer and a primer layer may be formed. Also, a heat insulation layer is preferably formed between the undercoat layer and the support. In the present specification, the term "intermediate layer" or "interlayer" means these layers, preferably the heat insulation layer. Moreover, it is preferable that a curling control layer, a writing layer and a charge control layer are formed on the backside of the support. Each layer is applied using a usual method such as a roll coating, a bar coating, a gravure coating and a gravure reverse coating. The receptor layer is preferably formed by coating a coating solution containing water as a main medium. The term "coating solution containing water as a main medium" means a coating solution containing water in an amount of generally 40 mass % or more, preferably 60 to 95 mass %, based on a whole medium.

<Receptor Layer>

[Thermoplastic Resin]

The heat-sensitive transfer image-receiving sheet used in the present invention contains at least one receptor layer containing at least one polymer selected from a group consisting of (a) polyester and/or polycarbonate polymers, (b) vinyl chloride polymers and a (c) polymer latex.

Examples of the polymer (thermoplastic resin) that may be used in the receptor layer in the present invention include vinyl-series polymers, such as halogenated polymers (e.g., polyvinyl chloride and polyvinylidene chloride), polyvinyl acetate, ethylene-vinyl acetate copolymer, vinyl chloride-vinyl acetate copolymer, polyacryl ester, polystylene, and polystylene acrylate; acetal-series polymers, such as polyvinylformal, polyvinylbutyral and polyvinylacetal; polyester-series polymers, such as polyethylene terephthalate, polybutylene terephthalate and polycaprolactone (e.g., PLACCEL H-5 (trade name) manufactured by DAICEL CHEMICAL INDUSTRIES, LTD.); polycarbonate-series polymers; cellulose-series polymers, such as those described in JP-A-4-296595 and JP-A-2002-264543; cellulose-series polymers, such as cellulose acetate butyrate (e.g., CAB551-0.2 and CAB321-0.1 (each trade name) manufactured by Eastman Chemical Company); polyolefin-series polymers, such as polypropylene; and polyamide-series polymers, such as urea resins, melamine resins and benzoguanamine resins. These polymers may be used optionally blending with each other in the range of compatibility. Polymers used for forming the receptor layer are also disclosed in JP-A-57-169370, JP-A-57-207250 and JP-A-60-25793.

The receptor layer preferably contains, among these polymers, a polycarbonate, a polyester, a polyurethane, a polyvinyl chloride or its copolymer, a stylene-acrylonitrile copolymer, a polycaprolactone, or a mixture thereof, in addition to the (a) polyester and/or polycarbonate polymers, (b) vinyl chloride polymers or (c) polymer latex. Most preferred is a polycarbonate, a polyester, a polyvinyl chloride or its copolymer, or a mixture thereof.

The polycarbonate polymers, the polyester polymers, and the polyvinyl chloride polymers are explained in more detail below. The above-described polymers may be used solely or in combination with each other.

(Polyester Polymers)

The polyester polymers used in the receptor layer are explained in more detail.

The polyester polymers are obtained by polycondensation of a dicarboxylic acid component (including a derivative thereof) and a diol component (including a derivative thereof). The polyester polymers preferably contain an aromatic ring and/or an aliphatic ring. As to technologies of method of producing the alicyclic polyester, those described in JP-A-5-238167 are useful from the viewpoints of ability to incorporate a dye and image stability.

Examples of the dicarboxylic acid component include isophtharic acid, trimellitic acid, terephtharic acid, 1,4-cyclohexane dicarboxylic acid, and a mixture of two or more of these acids. The dicarboxylic acid component is preferably isophtharic acid, trimellitic acid, terephtharic acid, and a mixture of two or more of these acids. From a viewpoint of improvement in fastness to light, a dicarboxylic acid component having an alicyclic structure is more preferable as the dicarboxylic acid component. The dicarboxylic acid component is further preferably 1,4-cyclohexane dicarboxylic acid or isophtharic acid. Specifically, as the dicarboxylic acid component, a mixture of isophtharic acid in an amount of 50 to 100 mol %, trimellitic acid in an amount of 0 to 1 mol %, terephtharic acid in an amount of 0 to 50 mol %, and 1,4-cyclohexane dicarboxylic acid in an amount of 0 to 15 mol %, in which a total amount of these components is 100 mol %, is furthermore preferably used.

Examples of the diol component include ethylene glycol, polyethylene glycol, tricyclodecane dimethanol, 1,4-butanediol, bisphenol, and a mixture of two or more of these diols. The diol component is preferably ethylene glycol, polyethylene glycol or tricyclodecane dimethanol. From a viewpoint of improvement in fastness to light, a diol component having an alicyclic structure is more preferable as the diol component. Use can be made of an alicyclic diol component such as cyclohexanediol, cyclohexanedimethanol and cyclohexanediethanol, in addition to tricyclodecane dimethanol. The alicyclic diol component is preferably tricyclodecane dimethanol. Specifically, as the diol component, a mixture of ethylene glycol in an amount of 0 to 50 mol %, polyethylene glycol in an amount of 0 to 10 mol %, tricyclodecane dimethanol in an amount of 0 to 90 mol % (preferably from 30 to 90 mol %, more preferably from 40 to 90 mol %), 1,4-butanediol in an amount of 0 to 50 mol %, and bisphenol A in an amount of 0 to 50 mol %, in which a total amount of these components is 100 mol %, is furthermore preferably used.

In the present invention, as the polyester polymers, it is preferably to use polyester polymers obtained by polycondensation using at least one of the above-described dicarboxylic acid component and at least one of the above-described diol component, so that the thus-obtained polyester polymers could have a molecular weight (mass average molecular weight (Mw)) of generally about 11,000 or more, preferably about 15,000 or more, and more preferably about 17,000 or more. If polyester polymers of too low molecular weight are used, elastic coefficient of the formed receptor layer becomes low and also it raises lack of thermal resistance. Resultantly, it sometimes becomes difficult to assure the releasing property of the heat-sensitive transfer sheet and the image-receiving sheet. A higher molecular weight is more preferable from a viewpoint of increase in elastic coefficient. The molecular weight is not limited in particular, so long as such failure does not occur that a higher molecular weight makes the polymer difficult to be dissolved in a solvent for a coating solution at the time of forming the receptor layer, or that an adverse effect arises in adhesive properties of the receptor layer to a substrate sheet after coating and drying the receptor layer. However, the molecular weight is preferably about 25,000 or less, and at highest a degree of about 30,000. The polyester polymers may be synthesized according to a known method.

Examples of a saturated polyester used as the polyester polymers, include VYLON 200, VYLON 290 and VYLON 600 (each trade name, manufactured by Toyobo Co., Ltd.), KA-1038C (trade name, manufactured by Arakawa Chemical Industries, Ltd.), and TP220 and TP235 (each trade name, manufactured by The Nippon Synthetic Chemical Industry Co., Ltd.).

(Polycarbonate Polymers)

The polycarbonate polymers used in the receptor layer are explained in more detail.

The polycarbonate means a polyester composed of a carbonic acid and a diol as a unit. The polycarbonate polymers can be synthesized by, for example, a method in which a diol and a phosgene are reacted or a method in which a diol and a carbonic acid ester are reacted.

Examples of the diol component include bisphenol A, ethylene glycol, propylene glycol, diethylene glycol, butanediol, pentanediol, hexanediol, 1,4-cyclohexanedimethanol, nonanediol, 4,4'-bicyclo(2,2,2,)hepto-2-ylidene bisphenol, 4,4'-(octahydro-4,7-methano-5H-indene-5-ylidene)bisphenol and 2,2',6,6'-tetrachloro bisphenol A. Preferred are bisphenol A, ethylene glycol, diethylene glycol, butanediol and pentanediol. More preferred are bisphenol A, ethylene glycol and butanediol. Especially preferred are bisphenol A and ethylene glycol. As for the polycarbonate polymers used in the present invention, at least one of the above-described diol components is preferably used. A plurality of diols may be used as a mixture thereof.

The following is a detailed explanation of a bisphenol A-polycarbonate that is an especially preferred embodiment.

Technologies of unmodified polycarbonates centering the bisphenol A-polycarbonate are described in U.S. Pat. No. 4,695,286. The polycarbonate polymers used in the present invention are a polycondensation compound having a molecular weight (weight average molecular weight (Mw)) of generally about 1,000 or more, preferably about 3,000 or more, more preferably about 5,000 or more, and especially preferably about 10,000 or more. Specific examples of the polycarbonate polymers include Makrolon-5700 (trade name, manufactured by Bayer AG) and LEXAN-141 (trade name, manufactured by General Electric Corporation).

Technologies of producing modified polycarbonates by mixing bisphenol A with a diol such as ethylene glycol are described in U.S. Pat. No. 4,927,803. The polyether block unit may be produced from a linear aliphatic diol having 2 to about 10 carbon atoms. But, a polyether block unit produced from ethylene glycol is preferred. In a preferred embodiment of the present invention, the polyether block unit has a number molecular weight of about 4,000 to about 50,000, while the bisphenol A polycarbonate block unit has a number molecular weight of about 15,000 to about 250,000. A molecular weight of the whole block copolymer is preferably in the range of about 30,000 to about 300,000. Specific examples thereof include Makrolon KL3-1013 (trade name, manufactured by Bayer A G).

It is also preferable that these unmodified and modified bisphenol A-polycarbonates are mixed together. Specifically, it is preferred to blend an unmodified bisphenol A-polycarbonate with a polyether-modified polycarbonate in a ratio by mass of from 80:20 to 10:90. The ratio by mass of from 50:50 to 40:60 is especially preferred from a viewpoint of improvement in resistance to finger print. Technologies of blending the unmodified and modified bisphenol A-polycarbonates are also described in JP-A-6-227160.

As for a preferable embodiment of the thermoplastic polymers used in the receptor layer, there can be included a blend series of the above-described polycarbonate polymers and the above-described polyester polymers. In the blend series, it is preferred to secure compatibility of the polycarbonate polymers and the polyester polymers. The polyester polymers preferably have a glass transition temperature (Tg) of about 40° C. to about 100° C., and the polycarbonate polymers preferably have a Tg of about 100° C. to about 200° C. It is preferable that the polyester polymers have a Tg lower than that of the polycarbonate polymers and act as a plasticizer to the polycarbonate polymers. A preferable Tg of a finished polyester/polycarbonate blend is in the range of 40° C. to 100° C. Even though a polyester/polycarbonate blend polymer has a higher Tg, it may be used advantageously by addition of a plasticizer.

In a further preferable embodiment, an unmodified bisphenol A-polycarbonate and polyester polymers are blended in such a ratio by mass that a Tg of the finished blend not only becomes a preferable value but also a cost can be controlled to the minimum. The polycarbonate polymers and the polyester polymers can be blended advantageously in a ratio by mass of approximately from 75:25 to 25:75. It is more preferable to blend them in a ratio by mass of from about 60:40 to about 40:60. Technologies of a blend series of the polycarbonate polymers and the polyester polymers are disclosed in JP-A-6-227161.

As for the polycarbonate polymers used in the receptor layer, a net structure of a bridged polymer may be formed in the receptor layer by reacting a polycarbonate having an average molecular weight of about 1,000 to about 10,000, the ends of which have at least 2 hydroxyl groups, with a crosslinking agent capable of reacting with the hydroxyl groups. As described in JP-A-6-155933, there can be used technologies for a crosslinking agent such as a multifunctional isocyanate, thereby to improve adhesiveness to a dye donator after transfer. Besides, as the technologies disclosed in JP-A-8-39942, there are technologies in which a receiving sheet for a heat-sensitive dye transfer process is constructed using dibutyl tin diacetate at a time of crosslinking reaction of a polycarbonate with isocyanate. Such the technologies enable to improve not only acceleration of the crosslinking reaction, but also image stability, resistance to finger print, and the like.

(Vinyl Chloride Polymers)

The vinyl chloride polymers, especially a copolymer derived from vinyl chloride, used in the receptor layer, is described in more detail.

The vinyl chloride copolymers are preferably one having a vinyl chloride constituent content of 85 to 97% by mass and a polymerization degree of 200 to 800. A monomer forming such a copolymer together with vinyl chloride has no particular restrictions, but any monomer may be used as far as it can be copolymerized with vinyl chloride. However, it is particularly preferably vinyl acetate. Accordingly, the vinyl chloride polymers used in the receptor layer are advantageously a vinyl chloride-vinyl acetate copolymer. However, the vinyl chloride-vinyl acetate copolymer is not necessarily constituted of vinyl chloride and vinyl acetate alone, and may include vinyl alcohol component, maleic acid component, or the like. Examples of other monomer constituents of such a copolymer constituted mainly of vinyl chloride and vinyl acetate include vinyl alcohol and its derivatives, such as vinyl alcohol and vinyl propionate; acrylic or methacrylic acids and their derivatives, such as acrylic acid and methacrylic acid, and their methyl, ethyl, propyl, butyl and 2-ethylhexyl esters; maleic acid and its derivatives, such as maleic acid, diethyl maleate, dibutyl maleate and dioctyl maleate; vinyl ether derivatives, such as methyl vinyl ether, butyl vinyl ether and 2-ethylhexyl vinyl ether; acrylonitrile and methacrylonitrile; and styrene. The ratio of each of the vinyl chloride and vinyl acetate components in the copolymer may be any ratio, but it is preferable that the ratio of the vinyl chloride component is 50 mass % or more of the copolymer. In addition, it is preferable that the ratio of the above-recited constituents other than the vinyl chloride and vinyl acetate is 10 mass % or less of the copolymer.

Examples of such a vinyl chloride-vinyl acetate copolymer include SOLBIN C, SOLBIN CL, SOLBIN CH, SOLBIN CN, SOLBIN C5, SOLBIN M, SOLBIN MF, SOLBIN A, SOLBIN AL, SOLBIN TA5R, SOLBIN TAO, SOLBIN MK6, and SOLBIN TA2 (trade names, manufactured by Nissin Chemical Industry Co., Ltd.); S-LEC A, S-LEC C and S-LEC M (trade names, manufactured by Sekisui Chemical Co., Ltd.); Vinylite VAGH, Vinylite VYHH, Vinylite VMCH, Vinylite VYHD, Vinylite VYLF, Vinylite VYNS, Vinylite VMCC, Vinylite VMCA, Vinylite VAGD, Vinylite VERR and Vinylite VROH (trade names, manufactured by Union Carbide Corporation); and DENKA VINYL 1000GKT, DENKA VINYL 1000L, DENKA VINYL 1000CK, DENKA VINYL 1000A, DENKA VINYL 1000LK$_2$, DENKA VINYL 1000AS, DENKA VINYL 1000MT$_2$, DENKA VINYL 1000CSK, DENKA VINYL 1000CS, DENKA VINYL 1000GK, DENKA VINYL 1000GSK, DENKA VINYL 10000GS, DENKA VINYL 1000LT$_3$, DENKA VINYL 1000D and DENKA VINYL 1000W (trade names, manufactured by Denki Kagaku Kogyo Kabushiki Kaisha).

(Polymer Latex)

In the present invention, a variety of polymer latex in addition to the above-described materials can be preferably used. The polymer latex is explained below.

In the heat-sensitive transfer image-receiving sheet for use in the present invention, the polymer latex that can be used in the receptor layer is preferably a dispersion in which hydrophobic polymers containing a water-insoluble vinyl chloride as a monomer unit are dispersed as fine particles in a water-soluble medium. The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. Latex polymers are described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki, and Keishi Kasahara, issued by Kobunshi Kanko Kai (1993); Soichi Muroi, "Gosei Latex no Kagaku (Chemistry of Synthetic Latex)", issued by Kobunshi Kanko Kai (1970); Yoshiaki Miyosawa (supervisor) "Suisei Coating-Zairyo no Kaihatsu to Oyo (Development and Application of Aqueous Coating Material)", issued by CMC Publishing Co., Ltd. (2004) and JP-A-64-538, and so forth. The dispersed particles preferably have a mean particle size (diameter) of about 1 to 50,000 nm, more preferably about 5 to 1,000 nm.

The particle size distribution of the dispersed particles is not particularly limited, and the particles may have either wide particle-size distribution or monodispersed particle-size distribution.

The latex polymer for use in the present invention may be ordinary latex polymer of a uniform structure or may be latex of the so-called core/shell type. When using a core/shell type latex polymer, it is preferred in some cases that the core and the shell have different glass transition temperatures. The glass transition temperature (Tg) of the latex polymer for use in the present invention is preferably −30° C. to 100° C., more preferably 0° C. to 80° C., further more preferably 10° C. to 70° C., and especially preferably 15° C. to 60° C.

As the polymer latex used in the receptor layer, there can be preferably used polyvinyl chlorides, a copolymer comprising a monomer unit of vinyl chloride such as a vinyl chloride-vinyl acetate copolymer, and a vinyl chloride acrylate copolymer. In case of the copolymer, the vinyl chloride monomer ratio is preferably in the range of from 50% to 95%. These polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The number average molecular weight of each of these polymers is preferably 5,000 to 1,000,000, and further preferably 10,000 to 500,000. Polymers having excessively small molecular weight impart insufficient dynamic strength to the layer containing the latex, and polymers having excessively large molecular weight bring about poor filming ability, and therefore both cases are undesirable. Crosslinkable latex polymers are also preferably used.

The polymer latex that can be used in the present invention is commercially available, and polymers described below may be utilized. Examples thereof include G351 and G576 (trade names, manufactured by Nippon Zeon Co., Ltd.); VINYBLAN 240, 270, 277, 375, 386, 609, 550, 601, 602, 630, 660, 671, 683, 680, 680S, 681N, 685R, 277, 380, 381, 410, 430, 432, 860, 863, 865, 867, 900, 900GT, 938 and 950 (trade names, manufactured by Nissin Chemical Industry Co., Ltd.).

Among the above examples, the polymer latex for use in the present invention is preferably polyvinyl chlorides, more preferably a copolymer of vinyl chloride and an acrylic ester, further preferably one having a glass transition temperature (Tg) of 30 to 80° C.

These latex polymers may be used singly, or two or more of these polymers may be blended, if necessary.

In the receptor layer, a ratio of the copolymer latex comprising a monomer unit of vinyl chloride occupying the whole solid content in the layer is preferably 50% or more.

In the present invention, it is preferable to prepare the receptor layer by applying an aqueous type coating solution and then drying it. The "aqueous type" so-called here means that 60% by mass or more of the solvent (dispersion medium) of the coating solution is water. As components other than water in the coating solution, water miscible organic solvents may be used, such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

The polymer latex for use in the present invention has a minimum film-forming temperature (MFT) of generally from −30 to 90° C., more preferably from 0 to 70° C. In order to control the minimum film-forming temperature, a film-forming aid may be added. The film-forming aid is also called a temporary plasticizer, and it is an organic compound (usually an organic solvent) that reduces the minimum film-forming temperature of the polymer latex. It is described in, for example, Souichi Muroi, "Gosei Latex no Kagaku (Chemistry of Synthetic Latex)", issued by Kobunshi Kanko Kai (1970). Preferable examples of the film-forming aid are listed below, but the compounds that can be used in the invention are not limited to the following specific examples.

Z-1: Benzyl alcohol

Z-2: 2,2,4-Trimethylpentanediol-1,3-monoisobutyrate

Z-3: 2-Dimethylaminoethanol

Z-4: Diethylene glycol

In the present invention, the above-described polymer latex may be used (blended) with another polymer latex. Preferable examples of the another polymer latex include polylactates, polyurethanes, polycarbonates, polyesters, polyacetals, and SBR's. Among these, polyesters and polycarbonates are preferable.

In combination with the above-described polymer latex for use in the present invention, any polymer can be used. The polymer that can be used in combination is preferably transparent or translucent, and generally colorless. The polymer may be a natural resin, polymer, or copolymer; a synthetic resin, polymer, or copolymer; or another film-forming medium; and specific examples include gelatins, polyvinyl alcohols, hydroxyethylcelluloses, cellulose acetates, cellulose acetate butyrates, polyvinylpyrrolidones, caseins, starches, polyacrylic acids, polymethylmethacrylic acids, polyvinyl chlorides, polymethacrylic acids, styrene-maleic anhydride copolymers, styrene-acrylonitrile copolymers, styrene-butadiene copolymers, polyvinyl acetals (e.g. polyvinyl formals, polyvinyl butyrals, etc.), polyesters, polyurethanes, phenoxy resins, polyvinylidene chlorides, polyepoxides, polycarbonates, polyvinyl acetates, polyolefins, and polyamides. In the coating liquid, a binder may be dissolved or dispersed in an aqueous solvent or in an organic solvent, or may be in the form of an emulsion.

The glass transition temperature (Tg) of the binder for use in the invention is preferably in the range of −30° C. to 70° C., more preferably −10° C. to 50° C., still more preferably 0° C. to 40° C., in view of film-forming properties (brittleness for working) and image storability. A blend of two or more types of polymers can be used as the binder. When a blend of two or more polymers is used, the average Tg obtained by summing up the Tg of each polymer weighted by its proportion, is preferably within the foregoing range. Also, when phase separation occurs or when a core-shell structure is adopted, the weighted average Tg is preferably within the foregoing range.

The glass transition temperature (Tg) is calculated according to the following equation:

$$1/Tg=\Sigma(Xi/Tgi)$$

wherein, assuming that the polymer is a copolymer composed of n monomers from i=1 to i=n, Xi is a weight fraction of the i-th monomer ($\Sigma Xi=1$) and Tgi is glass transition temperature (measured in absolute temperature) of a homopolymer formed from the i-th monomer. The symbol $\Sigma$ means the sum of i=1 to i=n. The value of the glass transition temperature of a homopolymer formed from each monomer (Tgi) is adopted from J. Brandrup and E. H. Immergut, "Polymer Handbook, 3rd. Edition", Wiley-Interscience (1989).

In the present invention, the polymer used for the binder can be easily obtained by a solution polymerization method, a suspension polymerization method, an emulsion polymerization method, a dispersion polymerization method, an anionic polymerization method, a cationic polymerization method, or the like. Above all, an emulsion polymerization method in which the polymer is obtained as a latex is the most preferable. Also, a method is preferable in which the polymer is prepared in a solution, and the solution is neutralized, or an emulsifier is added to the solution, to which water is then added, to prepare an aqueous dispersion by forced stirring. For example, an emulsion polymerization method comprises conducting polymerization under stirring at generally about 30° C. to about 100° C. (preferably 60° C. to 90° C.) for 3 to 24 hours by using water or a mixed solvent of water and a water-miscible organic solvent (such as methanol, ethanol, or acetone) as a dispersion medium, a monomer mixture in an amount of 5 mass % to 150 mass % based on the amount of the dispersion medium, an emulsifier and a polymerization initiator. Various conditions such as the dispersion medium, the monomer concentration, the amount of initiator, the amount of emulsifier, the amount of dispersant, the reaction temperature, and the method for adding monomers are suitably determined considering the type of the monomers to be used. Furthermore, it is preferable to use a dispersant when necessary.

In the coating solution of the latex polymer to be used in the present invention, an aqueous solvent can be used as the solvent of the coating solution, and a water-miscible organic solvent can be used additionally. Examples of usable water-miscible organic solvents include alcohols (for example, methyl alcohol, ethyl alcohol, and propyl alcohol), cellosolves (for example, methyl cellosolve, ethyl cellosolve, and butyl cellosolve), ethyl acetate, and dimethylformamide. The amount of the organic solvent to be added is preferably 50 mass % or less of the entire solvent, more preferably 30 mass % or less of the entire solvent.

Furthermore, in the polymer latex to be used in the present invention, the polymer concentration is, based on the amount of the latex liquid, preferably 10 mass % to 70 mass %, more preferably 20 mass % to 60 mass %, and especially preferably 30 mass % to 55 mass %.

The polymer latex in the image-receiving sheet that can be used in the present invention includes a state of a gel or dried film formed by removing a part of solvents by drying after coating.

[Emulsified Dispersion]

In the present invention, incorporation of an emulsified dispersion (emulsion) in the receptor layer is preferable, especially when the polymer latex is used.

The term "emulsification" as used herein follows the commonly used definition. According to "Kagaku Daijiten (ENCYCLOPEDIA CHIMICA)", Kyoritsu Shuppan Co., Ltd., for example, "emulsification" is defined as "a phenomenon in which, in one liquid, another liquid which does not dissolve in the first liquid are dispersed as fine globules, to form an emulsion". In addition, the term "emulsified dispersion" refers to "a dispersion in which fine globules of one liquid are dispersed in another liquid which does not dissolve the globules". The "emulsified dispersion" preferred in the present invention is "a dispersion of oil globules in water". The content of an emulsified dispersion in the image-receiving sheet for used in the present invention is preferably from 0.03 g/m$^2$ to 25.0 g/m$^2$, more preferably from 1.0 g/m$^2$ to 20.0 g/m$^2$.

In the present invention, it is preferable that a high-boiling solvent be included as an oil-soluble substance in the emulsified dispersion. Examples of the high-boiling solvent preferably used include phthalic acid esters (such as dibutyl phthalate, dioctyl phthalate, and di-2-ethyl-hexyl phthalate), phosphoric or phosphonic acid esters (such as triphenyl phosphate, tricresyl phosphate, tri-2-ethylhexyl phosphate), fatty acid esters (such as di-2-ethylhexyl succinate and tributyl citrate), benzoic acid esters (such as 2-ethylhexyl benzoate and dodecylbenzoate), amides (such as N,N-diethyidodecanamide and N,N-dimethyloleinamide), alcohol and phenol compounds (such as isostearyl alcohol and 2,4-di-tert-amylphenol), anilines (such as N,N-dibutyl-2-butoxy-5-tert-octylaniline), chlorinated paraffins, hydrocarbons (such as dodecylbenzene and diisopropylnaphthalene), and carboxylic acids (such as 2-(2,4-di-tert-amylphenoxy)butyric acid). Of these high-boiling solvents, phosphoric or phosphonic acid esters (such as triphenyl phosphate, tricresyl phosphate, and tri-2-ethylhexyl phosphate) are preferred over the others. In addition to such a high-boiling solvent, an organic solvent having a boiling point of 30° C. to 160° C. (such as ethyl acetate, butyl acetate, methyl ethyl ketone, cyclohexanone, methyl cellosolve acetate, or dimethylformamide) may be used as an auxiliary solvent. The content of high-boiling solvent in the emulsified dispersion is preferably from 3.0 to 25% by mass, and more preferably from 5.0 to 20% by mass.

It is preferable that the emulsified dispersion further contain an agent for imparting fastness to images and an ultraviolet absorbent. The compounds preferably used as such agents are any of the compounds represented by formulae (B), (Ph), (E-1) to (E-3), (TS-I) to (TS-VII), (TS-VIIIA), (UA) to (UE) disclosed in JP-A-2004-361936. Further, homopolymers or copolymers insoluble in water and soluble in organic solvents (preferably the compounds disclosed in JP-A-2004-361936, paragraph Nos. 0208 to 0234) may be included therein.

[Plasticizer]

For the purpose of enhancing the sensitivity of the receptor layer, a plasticizer (high-boiling organic solvent) may also be added. Examples of such a plasticizer include compounds generally used as plasticizers for vinyl chloride resins, and more specifically monomeric plasticizers such as phthalates, phosphates, adipates and sebacates, and polyester-type plasticizers produced by polymerization of adipic acid or sebacic acid and polyethylene glycol. The former plasticizers are generally low in molecular weight. As the plasticizer, olefin-type special copolymer resins, which are used as a polymeric plasticizer usable for vinyl chloride resins, may be used. Examples of resins usable for such a purpose include products marketed under the names of ELVALOY 741, ELVALOY 742, ELVALOY HP443, ELVALOY HP553, ELVALOY HP4015, ELVALOY EP4043, and ELVALOY EP4051 (trade names, manufactured by DuPont-Mitsui Polychemicals Co., Ltd.). Such plasticizers can be added to the resins in a proportion of about 100% by mass, but it is appropriate to use them in a proportion of 30% by mass or below in view of bleeding of prints. When the polymer latex is used, it is preferable that those plasticizers are used in a state of the emulsified dispersion as mentioned above.

The receptor layer for use in the present invention can be cast by extrusion coating of a fused matter of the polymer resin as recited above without resorting to solvent coating. The techniques of this extrusion coating are described in *Encyclopedia of Polymer Science and Engineering*, vol. 3, p. 563, John Wiley, New York (1985), and supra, vol. 6, p. 608 (1986). In addition, the technique for heat-sensitive dye transfer materials is disclosed in JP-A-7-179075, and it is also applicable to the present invention. As the polymer resin, copolymer obtained by condensing cyclohexane dicarboxylate and a 50:50 by mole % mixture of ethylene glycol and bisphenol-A-diethanol (COPOL; registered trade mark) is especially preferred.

[Releasing Agent]

If the image-receiving surface of the heat-sensitive transfer image-receiving sheet lacks a sufficient releasing property, problems of so-called abnormal transfer arises. Examples of the abnormal transfer include a problem that a heat-sensitive transfer sheet and a heat-sensitive transfer image-receiving sheet (image-receiving sheet) mutually weld by heat from a thermal head for the image-forming, and thereby a big noise due to peeling arises at the time of peeling; a problem that a dye layer is entirely transferred; and a problem that the receptor layer is peeled from the support. As a method of solving such problems of releasing property, it is known that various kinds of releasing agents (lubricant) are incorporated in the receptor layer and that a releasing layer is additionally disposed on the receptor layer. In the present invention, it is preferable to use a releasing agent in the receptor layer in order to keep more securely the releasing property between the heat-sensitive transfer sheet and the image-receiving sheet at the time of printing images.

As the releasing agent, solid waxes such as polyethylene wax, amide wax and Teflon (registered trade name) powder; silicone oil, phosphate-series compounds, fluorine-based surfactants, silicone-based surfactants and others including releasing agents known in the technical fields concerned may be used. Among these, fluorine-series compounds typified by fluorine-based surfactants, silicone-based surfactants and silicone-series compounds such as silicone oil and/or its hardened products are preferably used.

As the silicone oil, straight silicone oil and modified silicone oil or their hardened products may be used.

Examples of the straight silicone oil include dimethylsilicone oil, methylphenylsilicone oil and methyl hydrogen silicone oil. Examples of the dimethylsilicone oil include KF96-10, KF96-100, KF96-1000, KF96H-10000, KF96H-12500 and KF96H-100000 (all of these names are trade names, manufactured by Shin-Etsu Chemical Co., Ltd.). Examples of the methylphenylsilicone oil include KF50-100, KF54 and KF56 (all of these names are trade names, manufactured by Shin-Etsu Chemical Co., Ltd.).

The modified silicone oil may be classified into reactive silicone oils and non-reactive silicone oils. Examples of the reactive silicone oils include amino-modified, epoxy-modified, carboxyl-modified, hydroxy-modified, methacryl-modified, mercapto-modified, phenol-modified or one-terminal reactive/hetero-functional group-modified silicone oils. Examples of the amino-modified silicone oil include KF-393, KF-857, KF-858, X-22-3680, X-22-3801C, KF-8010, X-22-161A and KF-8012 (all of these names are trade names, manufactured by Shin-Etsu Chemical Co., Ltd.). Examples of the epoxy-modified silicone oil include KF-100T, KF-101, KF-60-164, KF-103, X-22-343 and X-22-3000T (all these names are trade names, manufactured by Shin-Etsu Chemical Co., Ltd.). Examples of the carboxyl-modified silicone oil include X-22-162C (trade name, manufactured by Shin-Etsu Chemical Co., Ltd.). Examples of the hydroxy-modified silicone oil include X-22-160AS, KF-6001, KF-6002, KF-6003, X-22-170DX, X-22-176DX, X-22-176D and X-22-176DF (all of these names are trade names, manufactured by Shin-Etsu Chemical Co., Ltd.). Examples of the methacryl-modified silicone oil include X-22-164A, X-22-164C, X-24-8201, X-22-174D and X-22-2426 (all of these names are trade names, manufactured by Shin-Etsu Chemical Co., Ltd.).

Reactive silicone oils may be hardened upon use, and may be classified into, for example, reaction-curable type, photocurable type and catalyst-curable type. Among these types, silicone oil that is the reaction-curable type is particularly preferable. As the reaction-curable type silicone oil, products obtained by reacting an amino-modified silicone oil with an epoxy-modified silicone oil and then by curing are desirable. Also, examples of the catalyst-curable type or photocurable type silicone oil include KS-705F-PS, KS-705F-PS-1 and KS-770-PL-3 (all of these names are trade names, catalyst-curable silicone oils, manufactured by Shin-Etsu Chemical Co., Ltd.) and KS-720 and KS-774-PL-3 (all of these names are trade names, photocurable silicone oils, manufactured by Shin-Etsu Chemical Co., Ltd.). The addition amount of the curable type silicone oil is preferably 0.5 to 30% by mass based on the resin constituting the receptor layer. The releasing agent is used generally in an amount of 2 to 4% by mass and preferably 2 to 3% by mass based on 100 parts by mass of the polyester resin. If the amount is too small, the releasability cannot be secured without fail, whereas if the amount is excessive, a protective layer is not transferred to the image-receiving sheet resultantly.

Examples of the non-reactive silicone oil include polyether-modified, methylstyryl-modified, alkyl-modified, higher fatty acid ester-modified, hydrophilic special-modified, higher alkoxy-modified or fluorine-modified silicone oils. Examples of the polyether-modified silicone oil include KF-6012 (trade name, manufactured by Shin-Etsu Chemical Co., Ltd.) and examples of the methylstyryl-modified silicone oil include 24-510 (trade name, manufactured by Shin-Etsu Chemical Co., Ltd.). Modified silicones represented by any one of the following Formulae 11 to 13 may also be used.

Formula 11

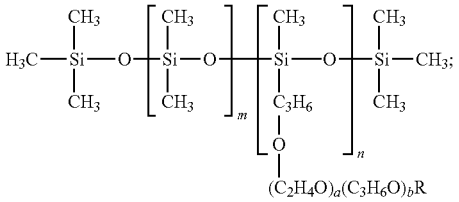

In the Formula 11, R represents a hydrogen atom or a straight-chain or branched alkyl group which may be substituted with an aryl or cycloalkyl group. m and n respectively denote an integer of 2,000 or less, and a and b respectively denote an integer of 30 or less.

Formula 12

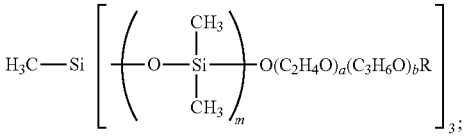

In the Formula 12, R represents a hydrogen atom or a straight-chain or branched alkyl group which may be substituted with an aryl or cycloalkyl group. m denotes an integer of 2,000 or less, and a and b respectively denote an integer of 30 or less.

Formula 13

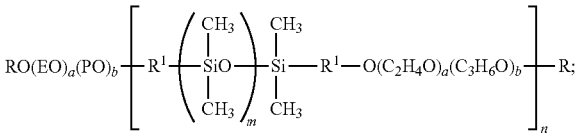

In the Formula 13, R represents a hydrogen atom or a straight-chain or branched alkyl group which may be substituted with an aryl or cycloalkyl group. $R^1$ represents a single bond or a divalent linking group, E represents an ethylene group which may be further substituted, and P represents a propylene group which may be further substituted. m and n each independently denote an integer of 2,000 or less, and a and b each independently denote an integer of 30 or less.

Silicone oils such as those mentioned above are described in "SILICONE HANDBOOK" (The Nikkan Kogyo Shimbun, Ltd.) and the technologies described in each publication of JP-A-8-108636 and JP-A-2002-264543 may be preferably used as the technologies to cure the curable type silicone oils.

In some cases, a dye binder is transferred to the receptor layer in a highlight portion of monochrome printing, to cause an irregular transfer. In addition, it is known that an addition polymerization-type silicone generally progresses a hardening reaction in the presence of a catalyst, and that almost all of complexes of transition metal of VIII group, such as Fe group and Pt group, are effective as the hardening catalyst. Among these, a platinum compound has the highest efficiency in general, and a platinum catalyst, which is generally a platinum complex soluble in the silicone oil, is preferably used. Addition amount necessary for the reaction is generally sufficiently about 1 to 100 ppm.

This platinum catalyst has a strong interaction with an organic compound containing an element such as N, P and S, an ionic compound of heavy metal such as Sn, Pb, Hg, Bi and As, or an organic compound containing a polyvalent bond such as an acetylene group. Therefore, if the above-described compounds (catalyst poison) are used together with the platinum catalyst, the ability of the catalyst to hydrosilylate is lost. Resultantly, the platinum catalyst cannot work as the hardening catalyst. Therefore, a problem arises that the platinum catalyst causes silicone to lack in hardening ability, when used with such a catalyst poison (See "Silicone Handbook" published by Nikkan Kogyo Shunbun shya). As a result, such an addition polymerization-type silicone causing such a hardening failure cannot show a releasability needed, when it is used in the receptor layer. As a hardener reacting with an active hydrogen, it is considered to use an isocyanate compound. However, this isocyanate compound and an organic tin compound working as a catalyst to the isocyanate compound act as a catalyst poison to the platinum catalyst. Therefore, the addition polymerization-type silicone has been never used together with the isocyanate compound in the past. Resultantly, the addition polymerization-type silicone has been never used together with a modified silicone having an active hydrogen, that shows a releasability needed, when hardened with the isocyanate compound.

However, the hardening failure of the addition polymerization-type silicone can be prevented by 1) setting an equivalent amount of the reactive group of the hardener capable of reacting with the active hydrogen, to the reactive group of both the thermoplastic resin and the modified silicone having an active hydrogen, in the range of from 1:1 to 10:1, and 2) setting an addition amount of the platinum catalyst based on the addition polymerization-type silicone in the range of 100 to 10,000 ppm in terms of platinum atom of the platinum catalyst. If the equivalent amount of the reactive group of the hardener capable of reacting with the active hydrogen according to the 1) described above is too small, an amount of silicone having an active hydrogen hardened with an active hydrogen of the thermoplastic resin is so small that an excellent releasability needed cannot be achieved. On the other hand, if the equivalent ratio is too large, a time which is allowed to use an ink in a coating solution for the receptor layer is so short that such the equivalent ratio cannot be substantially applied to the present invention. Beside, if the addition amount of the platinum catalyst according to the 2) described above is too small, activity is lost by the catalyst poison, whereas if the addition amount is too large, a time which is allowed to use an ink in a coating solution for the receptor layer is so short that such the addition amount cannot be substantially applied to the present invention.

The amount of the receptor layer to be applied is preferably 0.5 to 10 g/m$^2$ (solid basis, hereinafter, the amount to be applied in the present specification is a value on solid basis unless otherwise noted).

<Releasing Layer>

In the case where the hardened modified silicone oil is not added to the receptor layer, the silicone oil may be added to a releasing layer formed on the receptor layer. In this case, the receptor layer may be provided using at least one of the above-described thermoplastic resins. Besides, a receptor layer to which silicone is added may be used. The releasing layer contains a hardened modified silicone oil. A kind of the silicone to be used and a method of using the silicone are the same as for use in the receptor layer. Also, in the case where a catalyst or a retardant is used, addition of these additives to the receptor layer may be applied. The releasing layer may be formed using only a silicone, or alternatively a mixture of a silicone and a binder resin having a good compatibility therewith. A thickness of the releasing layer is generally in the range of about 0.001 to about 1 g/m$^2$.

Examples of the fluorine surfactants include Fluorad FC-430 and FC-431 (trade names manufactured by 3M).

<Undercoat Layer>

An undercoat layer is preferably formed between the receptor layer and the support. As the undercoat layer, for example, a white background regulation layer, a charge regulation layer, an adhesive layer or a primer layer is formed. These layers may be formed in the same manner as those described in, for example, each specification of Japanese Patent Nos. 3,585,599 and 2,925,244.

<Heat Insulation Layer>

In the present invention, the heat insulation layer (foam layer) serves to protect a support from heat when a thermal head is used to carry out a transfer operation under heating. Also, because the heat insulation layer has high cushion characteristics, a thermal transfer image-receiving sheet having high printing sensitivity can be obtained even in the case of using paper as the substrate.

The heat insulation layer is generally made of a resin and a foaming agent. As the resin for the heat insulation layer, known resins such as a urethane resin, acryl resin, methacryl resin and modified olefin resin or those obtained by blending these resins may be used. Each of these resins is dissolved and/or dispersed in an organic solvent or water and the resultant is applied to form a heat insulation layer. The coating solution for the heat insulation layer is preferably an aqueous type coating solution having no influence on the foaming agent. As the coating solution, for example, a water-soluble, water-dispersible or SBR latex, emulsions including a urethane-series emulsion, polyester emulsion, emulsion of vinyl acetate and its copolymer, emulsion of a copolymer of acryl types such as acryl or acrylstyrene, vinyl chloride emulsion, or dispersions of these emulsions may be used. When a microsphere which will be explained later is used as the foaming agent, it is preferable to use an emulsion of vinyl acetate or its copolymer or an emulsion of a copolymer of acryl such as acryl or acrylstyrene.

The glass transition point, softness and filmforming characteristics of these resins can be easily controlled by changing the kind and ratio of the monomer to be copolymerized, and are therefore suitable in the point that desired characteristics are obtained even if a plasticizer and filming adjuvant are not added, that a film is reduced in a change in color when it is stored in various environments after formed, and that it is reduced in material properties with time. Also, among the above resins, the SBR latex is undesirable because it usually has a low glass transition point, tends to cause blocking and tends to be yellowed after the film is formed or while it is stored. The urethane-series emulsion is undesirable because many urethane emulsions contain solvents such as NMP and DMF and therefore tends to have an adverse influence on a foaming agent. The polyester emulsion or dispersion and the vinyl chloride emulsion are undesirable because they generally have high glass transition points, and cause a deterioration in the foaming characteristics of a microsphere. Though there are those which are soft, they are not used preferably because the softness is imparted by adding a plasticizer.

The foaming characteristics of the foaming agent are largely affected by the hardness of a resin. In order to foam the foaming agent at a desired expansion ratio, the resin is preferably those having a glass transition point of −30 to 20° C. or a minimum filmforming temperature (MFT) of 20° C. or less. Resins having a too high glass transition point lack in softness and cause a deterioration in the foaming characteristics of the foaming agent. Also, resins having a too low glass transition point give rise to blocking caused by adhesiveness (generated on the foaming layer and on the backside of the substrate when the substrate on which the foaming layer has been formed is rolled) and cause defects (for instance, when the image-receiving sheet is cut, the resin of the foaming layer adheres to a cutter blade, which deteriorates outward appearance or allows cutting dimension to be out of order). Also, resins, of which the minimum filmforming temperature is too high, cause film-forming inferiors during coating and drying, giving rise to disorders such as surface cracks.

Examples of the foaming agent include known foaming agents, for example, decomposition type foaming agents such as dinitropentamethylenetetramine, diazoaminobenzene, azobisisobutyronitrile and azodicarboamide, which are decomposed by heating to generate gases such as oxygen, hydrocarbon gas or nitrogen; and microspheres obtained by encapsulating a low-boiling point liquid such as butane and pentane with a resin such as polyvinylidene chloride or polyacrylonitrile to form a microcapsule. Among these materials, microspheres obtained by encapsulating a low-boiling point liquid such as butane and pentane with a resin such as polyvinylidene chloride or polyacrylonitrile to form a microcapsule are preferably used. These foaming agents are respectively foamed by heating after the foam layer is formed, and the resulting foamed layer has high cushion characteristics and heat insulation characteristics. The amount of the foaming agent is preferably in a range preferably from 0.5 to 100 parts by mass based on 100 parts by mass of the resin used to form the foaming layer. When the amount is too small, the cushion characteristics of the foam layer is reduced and therefore, the effect of the foam layer is not obtained. When the amount is too high, the hollow ratio of the foamed layer becomes so large that the mechanical strength of the foam layer is reduced and the foam layer cannot stand to usual handling. Also, the surface of the foam layer loses smoothness, producing an adverse effect on the outward appearance and image quality. Also, the thickness of the whole foam layer is preferably 30 to 100 μm. When the thickness is too thin, the foam layer has insufficient cushion characteristics and heat-insulation property, whereas when the thickness is too thick, the effect of the foam layer is not improved, bringing about reduced strength. Also, as to the particle diameter (size) of the foaming agent, the volume average particle diameter of the foaming agent before foaming is about 5 to 15 μm and the volume average particle diameter of the foaming agent after foaming is 20 to 50 μm. Foaming agents that is too small in average particle diameter before and after foaming impart a low cushion effect. Foaming agents that is too large in average particle diameter before and after foaming make the surface of the foam layer irregular, and eventually have an adverse influence on the quality of the formed image in some cases.

It is particularly preferable to use, among the above foaming agents, a low-temperature foaming type microsphere in which the softening point of the capsule wall and foaming start temperature are respectively 100° C. or less, and which has an optimum foaming temperature (temperature at which the expansion ratio is highest when a heating time is one minute) of 140° C. or less, and to make the heating temperature as low as possible at the time of foaming. The use of a microsphere having a lower foaming temperature makes it possible to prevent thermal wrinkles and curling of the substrate at the time of foaming. This microsphere having a low foaming temperature can be obtained by controlling the amount of a thermoplastic resin such as polyvinylidene chloride and polyacrilonitrile which forms the capsule wall. The volume average particle diameter (size) is preferably 5 to 15 μm. The foam layer formed using this microsphere has the advantages that air cells obtained by foaming are closed cells, the foam layer is foamed using a simple process using only heating and the thickness of the foam layer can be easily controlled by the amount of the microsphere to be compounded.

However, this microsphere is not resistant to an organic solvent. When a coating solution containing an organic solvent is used for the foam layer, the capsule wall of the microsphere is eroded, resulting in low foaming characteristics. Therefore, when a microsphere like the above is used, it is desirable to use an aqueous type coating solution that does not contain any organic solvent, for example, ketones such as acetone and methyl ethyl ketone, esters such as ethyl acetate and lower alcohols such as methanol and ethanol which erode the capsule wall. Accordingly, it is desirable to use an aqueous type coating solution, specifically, a solution using a water-soluble or water-dispersible resin or a resin emulsion and preferably an acrylstyrene emulsion or modified vinyl acetate emulsion. Also, even if an aqueous type coating solution is used to form a foam layer, a coating solution formulated with a high-boiling point and highly polar solvent such as NMP, DMF or cellosolve as a cosolvent, a filmforming auxiliary, or a plasticizer has an adverse influence on the microsphere. It is therefore necessary to take it into account, for example, to seize the composition of the aqueous resin to be used and the amount of the high-boiling point solvent to be added, to thereby confirm whether the microcapsule is adversely affected or not.

In the image-receiving sheet for use in the present invention, the heat insulation layer preferably contains hollow polymer particles.

Herein, the hollow polymer particles are polymer particles having independent pores inside of the particles. Examples of the hollow polymer particles include (1) non-foaming type hollow particles obtained in the following manner: water is contained inside of a capsule wall formed of a polystyrene, acryl resin, or styrene/acryl resin and, after a coating solution is applied and dried, the water in the particles is vaporized out of the particles, with the result that the inside of each particle forms a hollow; (2) foaming type microballoons obtained in the following manner: a low-boiling point liquid such as butane and pentane is encapsulated in a resin constituted of any one of polyvinylidene chloride, polyacrylonitrile, polyacrylic acid and polyacrylate, and their mixture or polymer, and after the resin coating material is applied, it is heated to expand the low-boiling point liquid inside of the particles whereby the inside of each particle is made to be hollow; and (3) microballoons obtained by foaming the above (2) under heating in advance, to make hollow polymer particles.

These hollow polymer particles preferably have a hollow ratio of about 20 to 70%, and may be used in combinations of two or more. Specific examples of the above (1) include Rohpake 1055 manufactured by Rohm and Haas Co.; Boncoat PP-1000 manufactured by Dainippon Ink and Chemicals, Incorporated; SX866(B) manufactured by JSR Corporation; and Nippol MH5055 manufactured by Nippon Zeon (all of these product names are trade names). Specific examples of the above (2) include F-30 and F-50 manufactured by Matsumoto Yushi-Seiyaku Co., Ltd. (all of these product names are trade names). Specific examples of the above (3) include F-30E manufactured by Matsumoto Yushi-Seiyaku Co., Ltd, and Expancel 461DE, 551DE and 551DE20 manufactured by Nippon Ferrite (all of these product names are trade names). The hollow polymer particles for use in the heat insulation layer may be a latex thereof.

A water-dispersible resin or water-soluble type resin is preferably contained, as a binder, in the heat insulation layer containing the hollow polymer particles. As the binder resin that can be used in the present invention, known resins such as an acryl resin, styrene/acryl copolymer, polystyrene resin, polyvinyl alcohol resin, vinyl acetate resin, ethylene/vinyl acetate copolymer, vinyl chloride/vinyl acetate copolymer, styrene/butadiene copolymer, polyvinylidene chloride resin, cellulose derivative, casein, starch, and gelatin may be used. Also, these resins may be used either singly or as mixtures. In the present invention, gelatin is particularly preferable.

When the heat insulation layer contains hollow polymer particles, it is preferable that the heat insulation layer contains no aqueous dispersion of a resin having poor resistance to an organic solvent, except for the hollow polymer particles. Incorporation of the resin having poor resistance to an organic solvent (resin having a dye-dyeing affinity) in the heat insulation layer is not preferable in view of increase in loss of image definition after image transfer. It is assumed that the color-edge definition loss increases by the reason that owing to the presence of both the resin having a dye-dyeing affinity and the hollow polymer particles in the heat insulation layer, a transferred dye that has dyed the receptor layer migrates through the heat insulation layer adjacent thereto at the lapse of time.

Herein, the term "poor resistance to an organic solvent" means that a solubility in an organic solvent (e.g., methyl ethyl ketone, ethyl acetate, benzene, toluene, xylene) is 1 mass % or more, preferably 0.5 mass % or more. For example, the above-mentioned polymer latex is included in the category of the resin having "poor resistance to an organic solvent".

The solid content of the hollow polymer particles in the heat insulation layer preferably falls in a range from 5 to 2,000 parts by mass, when the solid content of the binder resin is taken as 100 parts by mass. The solid content of the hollow polymer particles is preferably 50% by mass or more, more preferably 60% by mass or more, and further preferably 60% by mass or more, based on the total solid content of the hollow polymer particles and the binder resin.

Also, the ratio by mass of the solid content of the hollow polymer particles in the coating solution is preferably 1 to 70% by mass and more preferably 10 to 40% by mass. If the ratio of the hollow polymer particles is excessively low, sufficient heat insulation cannot be obtained, whereas if the ratio of the hollow polymer particles is excessively large, the adhesion between the hollow polymer particles is reduced, posing problems, for example, powder fall or film separation.

The particle size of the hollow polymer particles is preferably 0.1 to 20 μm, more preferably 0.1 to 2 μm and particularly preferably 0.1 to 1 μm. Also, the glass transition temperature (Tg) of the hollow polymer particles is preferably 70° C. or more and more preferably 100° C. or more.

In the present invention, incorporation of an emulsified dispersion (emulsion) in the heat insulation layer is preferable.

<Water-Soluble Polymer>

The receptor layer and/or the interlayer (e.g. heat insulation layer) preferably contain a water-soluble polymer. Herein, the "water-soluble polymer" means a polymer which dissolves, in 100 g water at 20° C., in an amount of preferably 0.05 g or more, more preferably 0.1 g or more, further preferably 0.5 g or more, and particularly preferably 1 g or more. The water-soluble polymer which can be used in the present invention is natural polymers (polysaccharide type, microorganism type, and animal type), semi-synthetic polymers (cellulose-based, starch-based, and alginic acid-based), and synthetic polymer type (vinyl type and others); and synthetic polymers including polyvinyl alcohols, and natural or semi-synthetic polymers using celluloses derived from plant as starting materials, which will be explained later, correspond to the water-soluble polymer usable in the present invention. The latex polymers recited above are not included in the water-soluble polymers which can be used in the present invention.

Among the water-soluble polymers which can be used in the present invention, the natural polymers and the semi-synthetic polymers will be explained in detail. Specific examples include the following polymers: plant type polysaccharides such as gum arabics, κ-carrageenans, ι-carrageenans, λ-carrageenans, guar gums (e.g. Supercol, manufactured by Squalon), locust bean gums, pectins, tragacanths, corn starches (e.g. Purity-21, manufactured by National Starch & Chemical Co.), and phosphorylated starches (e.g. National 78-1898, manufactured by National Starch & Chemical Co.); microbial type polysaccharides such as xanthan gums (e.g. Keltrol T, manufactured by Kelco) and dextrins (e.g. Nadex 360, manufactured by National Starch & Chemical Co.); animal type natural polymers such as gelatins (e.g. Crodyne B419, manufactured by Croda), caseins, sodium chondroitin sulfates (e.g. Cromoist CS, manufactured by Croda); cellulose-based polymers such as ethylcelluloses (e.g. Cellofas WLD, manufactured by I.C.I.), carboxymethylcelluloses (e.g. CMC, manufactured by DAICEL CHEMICAL INDUSTRIES, LTD.), hydroxyethylcelluloses (e.g. HEC, manufactured by DAICEL CHEMICAL INDUSTRIES, LTD.), hydroxypropylcelluloses (e.g. Klucel, manufactured by Aqualon), methylcelluloses (e.g. Viscontran, manufactured by Henkel), nitrocelluloses (e.g. Isopropyl Wet manufactured by Hercules), and cationated celluloses (e.g. Crodacel QM, manufactured by Croda); starches such as phosphorylated starches (e.g. National 78-1898, manufactured by National Starch & Chemical Co.); alginic acid-based compounds such as sodium alginates (e.g. Keltone, manufactured by Kelco) and propylene glycol alginates; and other polymers such as cationated guar gums (e.g. Hi-care 1000, manufactured by Alcolac) and sodium hyaluronates (e.g. Hyalure, manufactured by Lifecare Biomedial) (all of the names are trade names).

Among the water-soluble polymers which can be used in the present invention, the synthetic polymers will be explained in detail. Examples of the acryl type include sodium polyacrylates, polyacrylic acid copolymers, polyacrylamides, polyacrylamide copolymers, and polydiethylaminoethyl(meth)acrylate quaternary salts or their copolymers. Examples of the vinyl type include polyvinylpyrrolidones, polyvinylpyrrolidone copolymers, and polyvinyl alcohols. Examples of the others include polyethylene glycols, polypropylene glycols, polyisopropylacrylamides, polymethyl vinyl ethers, polyethyleneimines, polystyrenesulfonic acids or their copolymers, naphthalenesulfonic acid condensate salts, polyvinylsulfonic acids or their copolymers, polyacrylic acids or their copolymers, acrylic acid or its copolymers, maleic acid copolymers, maleic acid monoester copolymers, acryloylmethylpropanesulfonic acid or its copolymers, polydimethyidiallylammonium chlorides or their copolymers, polyamidines or their copolymers, polyimidazolines, dicyanamide type condensates, epichlorohydrin/dimethylamine condensates, Hofmann decomposed products of polyacrylamides, and water-soluble polyesters (Plascoat Z-221, Z-446, Z-561, Z-450, Z-565, Z-850, Z-3308, RZ-105, RZ-570, Z-730 and RZ-142 (all of these names are trade names), manufactured by Goo Chemical Co., Ltd.).

In addition, highly-water-absorptive polymers, namely, homopolymers of vinyl monomers having —COOM or —$SO_3M$ (M represents a hydrogen atom or an alkali metal) or copolymers of these vinyl monomers among them or with other vinyl monomers (for example, sodium methacrylate, ammonium methacrylate, Sumikagel L-5H (trade name) manufactured by Sumitomo Chemical Co., Ltd.) as described in, for example, U.S. Pat. No. 4,960,681 and JP-A-62-245260, may also be used.

As water-soluble synthetic polymers that can be used in the present invention, the polyvinyl alcohols are explained in detail below.

Examples of completely saponificated polyvinyl alcohol include PVA-105 [polyvinyl alcohol (PVA) content: 94.0 mass % or more; degree of saponification: 98.5±0.5 mol %; content of sodium acetate: 1.5 mass % or less; volatile constituent: 5.0 mass % or less; viscosity (4 mass %; 20° C.): 5.6±0.4 CPS]; PVA-110 [PVA content: 94.0 mass %; degree of saponification: 98.5±0.5 mol %; content of sodium acetate: 1.5 mass %; volatile constituent: 5.0 mass %; viscosity (4 mass %; 20° C.): 11.0±0.8 CPS]; PVA-117 [PVA content: 94.0 mass %; degree of saponification: 98.5±0.5 mol %; content of sodium acetate: 1.0 mass %; volatile constituent: 5.0 mass %; viscosity (4 mass %; 20° C.): 28.0±3.0 CPS]; PVA-117H [PVA content: 93.5 mass %; degree of saponification: 99.6±0.3 mol %; content of sodium acetate: 1.85 mass %; volatile constituent: 5.0 mass %; viscosity (4 mass %; 20° C.): 29.0±3.0 CPS]; PVA-120 [PVA content: 94.0 mass %; degree of saponification: 98.5±0.5 mol %; content of sodium acetate: 1.0 mass %; volatile constituent: 5.0 mass %; viscosity (4 mass %; 20° C.): 39.5±4.5 CPS]; PVA-124 [PVA content: 94.0 mass %; degree of saponification: 98.5±0.5 mol %; content of sodium acetate: 1.0 mass %; volatile constituent: 5.0 mass %; viscosity (4 mass %; 20° C.): 60.0±6.0 CPS]; PVA-124H [PVA content: 93.5 mass %, degree of saponification: 99.6±0.3 mol %; content of sodium acetate: 1.85 mass %; volatile constituent: 5.0 mass %; viscosity (4 mass %; 20° C.): 61.0±6.0 CPS]; PVA-CS [PVA content: 94.0 mass %; degree of saponification: 97.5±0.5 mol %; content of sodium acetate: 1.0 mass %; volatile constituent: 5.0 mass %; viscosity (4 mass %; 20° C.): 27.5±3.0 CPS]; PVA-CST [PVA content: 94.0 mass %; degree of saponification: 96.0±0.5 mol %; content of sodium acetate: 1.0 mass %; volatile constituent: 5.0 mass %; viscosity (4 mass %; 20° C.): 27.0±3.0 CPS]; and PVA-HC [PVA content: 90.0 mass %; degree of saponification: 99.85 mol % or more; content of sodium acetate: 2.5 mass %; volatile constituent: 8.5 mass %; viscosity (4 mass %; 20° C.): 25.0±3.5 CPS] (all trade names, manufactured by Kuraray Co., Ltd.), and the like.

Examples of partially saponificated polyvinyl alcohol include PVA-203 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.4±0.2 CPS]; PVA-204 [PVA content: 94.0 mass %; degree of saponification: 88.0±5 mol %; content of sodium acetate: 1.0 mass %; volatile constituent: 5.0 mass %; viscosity (4 mass %; 20° C.): 3.9±0.3 CPS]; PVA-205 [PVA content: 94.0 mass %; degree of saponification: 88.0±1.5 mol %; content of sodium acetate: 1.0 mass %; volatile constituent: 5.0 mass %; viscosity (4 mass %; 20° C.): 5.0±0.4 CPS]; PVA-210 [PVA content: 94.0 mass %; degree of saponification: 88.0±1.0 mol %; content of sodium acetate: 1.0 mass %; volatile constituent: 5.0 mass %; viscosity (4 mass %; 20° C.): 9.0±1.0 CPS]; PVA-217 [PVA content: 94.0 mass %; degree of saponification: 88.0±1.0 mol %; content of sodium acetate: 1.0 mass %; volatile constituent: 5.0 mass %; viscosity (4 mass %; 20° C.): 22.5±2.0 CPS]; PVA-220 [PVA content: 94.0 mass %; degree of saponification: 88.0±1.0 mol %; content of sodium acetate: 1.0 mass %; volatile constituent: 5.0 mass %; viscosity (4 mass %; 20° C.): 30.0±3.0 CPS]; PVA-224 [PVA content: 94.0 mass %; degree of saponification: 88.0±1.5 mol %; content of sodium acetate: 1.0 mass %; volatile constituent: 5.0 mass %; viscosity (4 mass %; 20° C.): 44.0±4.0 CPS]; PVA-228 [PVA content: 94.0 mass %; degree of saponification: 88.0±1.5 mol %; content of sodium acetate: 1.0 mass %; volatile constituent: 5.0 mass %; viscosity (4 mass %; 20° C.): 65.0±5.0 CPS]; PVA-235 [PVA content: 94.0 mass %; degree of saponification: 88.0±1.5 mol %; content of sodium acetate: 1.0 mass %; volatile constituent: 5.0 mass %; viscosity (4 mass %; 20° C.): 95.0±15.0 CPS]; PVA-217EE [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-217E [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-220E [PVA content: 94.0 mass %; degree of saponification: 88.0±1.0 mol %; content of sodium acetate: 1.0 mass %; volatile constituent: 5.0 mass %; viscosity (4 mass %; 20° C.): 31.0±4.0 CPS]; PVA-224E [PVA content: 94.0 mass %; degree of saponification: 88.0±1.0 mol %; content of sodium acetate: 1.0 mass %; volatile constituent: 5.0 mass %; viscosity (4 mass %; 20° C.): 45.0±5.0 CPS]; PVA-403 [PVA content: 94.0 mass %; degree of saponification: 80.0±1.5 mol %; content of sodium acetate: 1.0 mass %; volatile constituent: 5.0 mass %; viscosity (4 mass %; 20° C.): 3.1±0.3 CPS]; PVA-405 [PVA content: 94.0 mass %; degree of saponification: 81.5±1.5 mol %; content of sodium acetate: 1.0 mass %; volatile constituent: 5.0 mass %; viscosity (4 mass %; 20° C.): 4.8±0.4 CPS]; PVA-420 [PVA content: 94.0 mass %; degree of saponification: 79.5±1.5 mol %; content of sodium acetate: 1.0 mass %; volatile constituent: 5.0 mass %]; PVA-613 [PVA content: 94.0 mass %; degree of saponification: 93.5±1.0 mol %; content of sodium acetate: 1.0 mass %; volatile constituent: 5.0 mass %; viscosity (4 mass %; 20° C.): 16.5±2.0 CPS]; L-8 [PVA content: 96.0 mass %; degree of saponification: 71.0±1.5 mol %; content of sodium acetate: 1.0 mass % (ash); volatile constituent: 3.0 mass %; viscosity (4 mass %; 20° C.): 5.4±0.4 CPS] (all trade names, manufactured by Kuraray Co., Ltd.), and the like.

The above values were measured in the manner described in JIS K-6726-1977.

With respect to modified polyvinyl alcohols, those described in Koichi Nagano, et al., "Poval", Kobunshi Kankokai, Inc. are useful. The modified polyvinyl alcohols include polyvinyl alcohols modified by cations, anions, —SH compounds, alkylthio compounds, or silanols.

Examples of such modified polyvinyl alcohols (modified PVA) include C polymers such as C-118, C-318, C-318-2A, and C-506 (all being trade names of Kuraray Co., Ltd.); HL polymers such as HL-12E and HL-1203 (all being trade names of Kuraray Co., Ltd.); HM polymers such as HM-03 and HM-N-03 (all being trade names of Kuraray Co., Ltd.); K polymers such as KL-118, KL-318, KL-506, KM-118T, and KM-618 (all being trade names of Kuraray Co., Ltd.); M polymers such as M-115 (a trade name of Kuraray co., Ltd.); MP polymers such as MP-102, MP-202, and MP-203 (all being trade names of Kuraray Co., Ltd.); MPK polymers such as MPK-1, MPK-2, MPK-3, MPK-4, MPK-5, and MPK-6 (all being trade names of Kuraray Co., Ltd.); R polymers such as R-1130, R-2105, and R-2130 (all being trade names of Kuraray Co., Ltd.); and V polymers such as V-2250 (a trade name of Kuraray Co., Ltd.).

The viscosity of polyvinyl alcohol can be adjusted or stabilized by adding a trace amount of a solvent or an inorganic salt to an aqueous solution of polyvinyl alcohol, and there can be employed compounds described in the aforementioned reference "Poval", Koichi Nagano et al., published by Kobunshi Kankokai, pp. 144-154. For example, a coated surface quality can be improved by an addition of boric acid. The amount of boric acid added is preferably 0.01 to 40 mass % with respect to polyvinyl alcohol.

Preferred binders are transparent or semitransparent, generally colorless, and water-soluble. Examples include natural resins, polymers and copolymers; synthetic resins, polymers, and copolymers; and other media that form films: for example, rubbers, polyvinyl alcohols, hydroxyethyl celluloses, cellulose acetates, cellulose acetate butylates, polyvinylpyrrolidones, starches, polyacrylic acids, polymethyl methacrylates, polyvinyl chlorides, polymethacrylic acids, styrene/maleic acid anhydride copolymers, styrene/acrylonitrile copolymers, styrene/butadiene copolymers, polyvinylacetals (e.g., polyvinylformals and polyvinylbutyrals), polyesters, polyurethanes, phenoxy resins, polyvinylidene chlorides, polyepoxides, polycarbonates, polyvinyl acetates, polyolefins, cellulose esters, and polyamides.

An amount of the water-soluble polymer added to the receptor layer is preferably from 1 to 25% by mass, more preferably from 1 to 10% by mass based on the entire receptor layer.

<Crosslinking Agent>

It is preferable that the above-mentioned water-soluble polymer contained in the receptor layer and/or the interlayer (e.g., heat insulation layer) is partly or entirely crosslinked with a crosslinking agent.

The crosslinking agent is required to have a plurality of groups capable of reacting with an amino group, a carboxyl group, a hydroxyl group or the like, but the agent to be used may be suitably selected depending on the kind of the water-soluble polymer. Thus, there is no particular limitation for the kind of the crosslinking agent. It is suitable to use each of methods described in T. H. James; "THE THEORY OF THE PHOTOGRAPHIC PROCESS FOURTH EDITION", published by Macmillan Publishing Co., Inc. (1977), pp. 77 to 87, and crosslinking agents described in, for example, U.S. Pat. No. 4,678,739, col. 41; JP-A-59-116655, JP-A-62-245261, and JP-A-61-18942. Both crosslinking agents of an inorganic compound (e.g., chrome alum, boric acid and salts thereof) and crosslinking agents of an organic compound may be preferably used. Alternatively, the crosslinking agent to be used may be composed of a mixture solution containing a chelating agent and a zirconium compound, whose pH is in the range of 1 to 7, as described in JP-A-2003-231775.

Specific examples of the crosslinking agent include epoxy-series compounds (e.g., diglycidyl ethyl ether, ethyleneglycol diglycidyl ether, 1,4-butanediol diglycidyl ether, 1,6-diglycidyl cyclohexane, N,N-diglycidyl-4-glycidyloxyaniline, sorbitol polyglycidyl ether, glycerol polyglycidyl ether, compounds described in JP-A-6-329877, JP-A-7-309954 and the like, and DIC FINE EM-60 (trade name, manufactured by DAINIPPON INK AND CHEMICALS, INCORPORATED)), aldehyde-series compounds (e.g., formaldehyde, glyoxal, gluralaldehyde), active halogen-series compounds (e.g., 2,4-dichloro-4-hydroxy-1,3,5-s-triazine, and compounds described in U.S. Pat. No. 3,325,287 and the like), active vinyl-series compounds (e.g., 1,3,5-trisacryloyl-hexahydro-s-triazine, bisvinylsulfonylmethyl ether, N,N'-ethylene-bis(vinylsulfonylacetamido)ethane, and compounds described in JP-B-53-41220, JP-B-53-57257, JP-B-59-162546, JP-B-60-80846 and the like), mucohalogen acid compounds (e.g., mucochloric acid), N-carbamoylpyridinium salt compounds (e.g., (1-morpholinocarbonyl-3-pyridinio)methanesulfonate), haloamidinium salt compounds (e.g., 1-(1-chloro-1-pyridinomethylene)pyrrolidinium, 2-naphthalenesulfonate), N-methylol-series compounds (e.g., dimethylolurea, methyloldimethylhydantoin), carbodiimido compounds (e.g., polycarbodiimido compounds derived from isoholondiisocyanate as described in JP-A-59-187029 and JP-B-5-27450, carbodiimido compounds derived from tetramethylxylylene diisocyanate as described in JP-A-7-330849, multi-branch type carbodiimido compounds described in JP-A-10-30024, carbodiimido compounds derived from dicyclohexylmethane diisocyanate as described in JP-A-2000-7642, and CARBODILITE V-02, V-02-L2, V-04, V-06, E-01 and E-02 (trade names, manufactured by Nisshinbo Industries, Inc.)), oxazoline compounds (e.g., oxazoline compounds described in JP-A-2001-215653 and EPOCROS K-1010E, K-1020E, K-1030E, K-2010E, K-2020E, K-2030E, WS-500 and WS-700 (trade names, manufactured by NIPPON SHOKUBAI CO., LTD.)), isocyanate compounds (e.g., dispersible isocyanate compounds described in JP-A-7-304841, JP-A-8-277315, JP-A-10-45866, JP-A-9-71720, JP-A-9-328654, JP-A-9-104814, JP-A-2000-194045, JP-A-2000-194237 and JP-A-2003-64149, and Duranate WB40-100, WB40-80D, WT20-100 and WT30-100 (trade names, manufactured by Asahi Kasei Corporation), CR-60N (trade name, manufactured by DAINIPPON INK AND CHEMICALS, INCORPORATED)), polymer (high molecular) hardeners (e.g., compounds described in JP-A-62-234157 and the like); boric acid and salts thereof, borax, and alum.

Preferable compounds as the crosslinking agent include epoxy-series compounds, aldehyde-series compounds, active halogen-series compounds, active vinyl-series compounds, N-carbamoylpyridinium salt compounds, N-methylol-series compounds (e.g., dimethylolurea, methyloldimethylhydantoin), carbodiimido compounds, oxazoline compounds, isocyanate compounds, polymer hardeners (e.g., compounds described in JP-A-62-234157 and the like), boric acid and salts thereof, borax, and alum. More preferable crosslinking agent include epoxy-series compounds, active halogen-series compounds, active vinyl-series compounds, N-carbamoylpyridinium salt compounds, N-methylol-series compounds (e.g., dimethylolurea, methyloldimethylhydantoin), polymer hardeners (e.g., compounds described in JP-A-62-234157 and the like) and boric acid. The above-mentioned crosslinking agent may be used singly or in combination of two or more.

The crosslinking agent that can be used in the present invention may be added to the water-soluble polymer solution in advance, or may be added at the last step for the preparation of the coating solution. Alternatively, the crosslinking agent may be added just before the coating.

The water-soluble polymer in the receptor layer is preferably cross-linked in a ratio of from 0.1 to 20 mass %, more preferably from 1 to 10 mass %, among the entire water-soluble polymer, even though the ratio varies depending on the kind of the crosslinking agent.

The addition amount of the crosslinking agent that can be used in the present invention varies depending on the kinds of the water-soluble binder and the crosslinking agent, but it is preferable that the amount is approximately in the range of from 0.1 to 50 mass parts, more preferably from 0.5 to 20 mass parts, and further more preferably from 1 to 10 mass parts, based on 100 mass parts of the water-soluble polymer contained in the constituting layer.

<Support>

As the support, coated paper, WP paper (double side laminated paper) or the like may be used.

(Coated Paper)

The coated paper is paper obtained by coating a sheet such as base paper with various resins, rubber latexes, or high-molecular materials, on one side or both sides of the sheet, wherein the coating amount differs depending on its use. Examples of such coated paper include art paper, cast coated paper, and Yankee paper.

It is proper to use a thermoplastic resin as the resin to be applied to the surface(s) of the base paper. As such a thermoplastic resin, the following thermoplastic resins (A) to (H) may be exemplified.

(A) Polyolefin resins such as polyethylene resin and polypropylene resin; copolymer resins composed of an olefin such as ethylene or propylene and another vinyl monomer; and acrylic resin.

(B) Thermoplastic resins having an ester linkage: for example, polyester resins obtained by condensation of a dicarboxylic acid component (such a dicarboxylic acid component may be substituted with a sulfonic acid group, a carboxyl group, or the like) and an alcohol component (such an alcohol component may be substituted with a hydroxyl group, or the like); polyacrylate resins or polymethacrylate resins such as polymethylmethacrylate, polybutylmethacrylate, polymethylacrylate, polybutylacrylate, or the like; polycarbonate resins, polyvinyl acetate resins, styrene acrylate resins, styrene-methacrylate copolymer resins, vinyltoluene acrylate resins, or the like.

Concrete examples of them are those described in JP-A-59-101395, JP-A-63-7971, JP-A-63-7972, JP-A-63-7973, and JP-A-60-294862.

Commercially available thermoplastic resins usable herein are, for example, Vylon 290, Vylon 200, Vylon 280, Vylon 300, Vylon 103, Vylon GK-140, and Vylon GK-130 (products of Toyobo Co., Ltd.); Tafton NE-382, Tafton U-5, ATR-2009, and ATR-2010 (products of Kao Corporation); Elitel UE 3500, UE 3210, XA-8153, KZA-7049, and KZA-1449 (products of Unitika Ltd.); and Polyester TP-220 and R-188 (products of The Nippon Synthetic Chemical Industry Co., Ltd.); and thermoplastic resins in the Hyros series from Seiko Chemical Industries Co., Ltd., and the like (all of these names are trade names).

(C) Polyurethane resins, etc.

(D) Polyamide resins, urea resins, etc.

(E) Polysulfone resins, etc.

(F) Polyvinyl chloride resins, polyvinylidene chloride resins, vinyl chloride/vinyl acetate copolymer resins, vinyl chloride/vinyl propionate copolymer resins, etc.

(G) Polyol resins such as polyvinyl butyral; and cellulose resins such as ethyl cellulose resin and cellulose acetate resin, and (H) Polycaprolactone resins, styrene/maleic anhydride resins, polyacrylonitrile resins, polyether resins, epoxy resins, and phenolic resins.

The thermoplastic resins may be used either alone or in combination of two or more.

The thermoplastic resin may contain a whitener, a conductive agent, a filler, a pigment or dye including, for example, titanium oxide, ultramarine blue, and carbon black; or the like, if necessary.

(Laminated Paper)

The laminated paper is a paper which is formed by laminating various kinds of resin, rubber, polymer sheets or films on a sheet such as a base paper or the like. Specific examples of the materials useable for the lamination include polyolefins, polyvinyl chlorides, polyethylene terephthalates, polystyrenes, polymethacrylates, polycarbonates, polyimides, and triacetylcelluloses. These resins may be used alone, or in combination of two or more.

Generally, the polyolefins are prepared by using a low-density polyethylene. However, for improving the thermal resistance of the support, it is preferred to use a polypropylene, a blend of a polypropylene and a polyethylene, a high-density polyethylene, or a blend of a high-density polyethylene and a low-density polyethylene. From the viewpoint of cost and its suitableness for the laminate, it is preferred to use the blend of a high-density polyethylene and a low-density polyethylene.

The blend of a high-density polyethylene and a low-density polyethylene is preferably used in a blend ratio (a mass ratio) of 1/9 to 9/1, more preferably 2/8 to 8/2, and most preferably 3/7 to 7/3. When the thermoplastic resin layer is formed on the both surfaces of the support, the back side of the support is preferably formed using, for example, the high-density polyethylene or the blend of a high-density polyethylene and a low-density polyethylene. The molecular weight of the polyethylenes is not particularly limited. Preferably, both of the high-density polyethylene and the low-density polyethylene have a melt index of 1.0 to 40 g/10 minute and a high extrudability.

The sheet or film may be subjected to a treatment to impart white reflection thereto. As a method of such a treatment, for example, a method of incorporating a pigment such as titanium oxide into the sheet or film can be mentioned.

The thickness of the support is preferably from 25 μm to 300 μm, more preferably from 50 μm to 260 μm, and further preferably from 75 μm to 220 μm. The support can have any rigidity according to the purpose. When it is used as a support for electrophotographic image-receiving sheet of photographic image quality, the rigidity thereof is preferably near to that in a support for use in color silver halide photography.

<Curling Control Layer>

When the support is exposed as it is, there is the case where the heat-sensitive transfer image-receiving sheet is made to curl by moisture and/or temperature in the environment. It is therefore preferable to form a curling control layer on the backside of the support. The curling control layer not only prevents the image-receiving sheet from curling but also has a water-proof function. For the curling control layer, a polyethylene laminate, a polypropylene laminate or the like is used. Specifically, the curling control layer may be formed in a manner similar to those described in, for example, JP-A-61-110135 and JP-A-6-202295.

<Writing Layer and Charge Controlling Layer>

For the writing layer and the charge control layer, an inorganic oxide colloid, an ionic polymer, or the like may be used. As the antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge control layer may be formed in a manner similar to those described in the specification of Japanese Patent No. 3585585.

Also, the heat-sensitive transfer image-receiving sheet may be used in various applications enabling thermal transfer recording, such as heat-sensitive transfer image-receiving sheets in a form of thin sheets (cut sheets) or rolls; cards; and transmission type manuscript-making sheets, by optionally selecting the type of support.

(3) Image-Forming

In the image-forming method of the present invention, imaging is achieved by superposing a heat-sensitive (thermal) transfer sheet on a heat-sensitive (thermal) transfer image-receiving sheet so that a thermal transfer layer of the heat-sensitive transfer sheet can be contacted with a receptor layer of the heat-sensitive transfer image-receiving sheet and giving thermal energy in accordance with image signals given from a thermal head.

Specifically, image-forming can be achieved by the similar manner to that as described in, for example, JP-A-2005-88545. In the present invention, a printing time is preferably less than 15 seconds, and more preferably in the range of 3 to 12 seconds, from the viewpoint of shortening a time taken until a consumer gets a print.

The present invention may be utilized for printers, copying machines and the like, which employs a heat-sensitive transfer recording system.

As a means for providing heat energy in the thermal transfer, any of the conventionally known providing means may be used. For example, a heat energy of about 5 to 100 mJ/mm$^2$ is applied by controlling recording time in a recording device such as a thermal printer (trade name: Video Printer VY-100, manufactured by Hitachi, Ltd.), whereby the expected object can be attained sufficiently.

An image formed according to the image-forming method of the present invention shows a vivid color hue and excellent fastness to light.

According to the present invention, it is possible to provide an image-forming method using a heat-sensitive transfer system, which shows a high dye-transferring rate from a heat-sensitive transfer sheet to a heat-sensitive transfer image-receiving sheet.

According to the image-forming method of the present invention, imaging can be performed so as to achieve a high rate of dye-transferring from a heat-sensitive transfer sheet. Besides, the present invention can be suitably applied to a high-quality full-color recording and the like.

The present invention will be described in more detail based on the following examples, but the invention is not intended to be limited thereto.

EXAMPLES

In the following Examples, the terms "part" and "%" are values by mass, unless they are indicated differently in particular.

Production Example 1

Preparation of Heat-Sensitive Transfer Sheets 1 to 8

A polyester film having 6.0 μm in thickness (trade name: Lumirror, manufactured by Toray Industries, Inc.), the back side of which had been subjected to a heat-resisting and sliding (smoothing) treatment with a thermosetting acryl resin (thickness: 1 μm), was used as the support. To the surface of the above-described polyester film, a thermal transfer layer-coating solution was applied by a wire bar coating so that the coating amount after dry could become 1 g/m$^2$, thereby to prepare a heat-sensitive transfer sheet 8 having a thermal transfer layer on the support.

<Coating Solution for Thermal Transfer Layer>

| <Yellow coating solution> | |
|---|---|
| Yellow dye 1 for comparison (Trade name: Macrolex Yellow 6G, manufactured by Byer) | 5.5 parts by mass |
| Polyvinylbutyral resin (Trade name: S-LEC BX-1, manufactured by Sekisui Chemical Co., Ltd.) | 4.5 parts by mass |
| Methyl ethyl ketone/toluene (1/1, at mass ratio) | 90 parts by mass |

Next, heat-sensitive transfer sheets 1 to 7 were prepared in the same manner as the heat-sensitive transfer sheet 8, except that the above-described dye 1 for comparison was replaced by an equivalent molar amount of dyes as set forth in the following Table 2, respectively.

TABLE 2

| Heat-sensitive transfer sheet No. | Dye |
|---|---|
| 1 | (1)-1 |
| 2 | (1)-2 |
| 3 | (1)-3 |
| 4 | (1)-4 |
| 5 | (2)-1 |
| 6 | (2)-2 |
| 7 | (2)-3 |
| 8 | Dye 1 for comparison |

Production Example 2

Preparation of Heat-Sensitive Transfer Image-Receiving Sheets 11 to 13

(Preparation of Support A)

A pulp slurry was prepared from 50 parts by mass of hardwood kraft pulp (LBKP) of acacia origin and 50 parts by mass of hardwood kraft pulp (LBKP) of aspen origin, by beating these pulps by means of a disk refiner until Canadian standard freeness reached to 300 ml.

To the pulp slurry thus prepared were added, on a pulp basis, 1.3 mass % of modified cationic starch (CAT0304L, trade name, manufactured by Nippon NSC), 0.15 mass % of anionic polyacrylamide (DA4104, trade name, manufactured by Seiko PMC Corporation), 0.29 mass % of an alkylketene dimer (SIZENPINE K, trade name, manufactured by Arakawa Chemical Industries, Ltd.), 0.29 mass % of epoxidated behenic acid amide, and 0.32 mass % of polyamide polyamine epichlorohydrin (ARAFIX 100, trade name, manufactured by Arakawa Chemical Industries, Ltd.), and thereafter 0.12 mass % of a defoaming agent was further added.

The resulting pulp slurry was made into paper by use of a fourdrinier paper machine. In a process of drying in which the felt side of web was pressed against a drum dryer cylinder via a dryer canvas, the web thus formed was dried under a condition that the tensile strength of the dryer canvas was adjusted to 1.6 kg/cm. Then, each side of the raw paper thus made was coated with 1 g/m$^2$ of polyvinyl alcohol (KL-118, trade name, manufactured by Kuraray Co., Ltd.) with a size press, then, dried and further subjected to calendering treatment. Therein, the papermaking was performed so that the raw paper had a grammage (basis weight) of 157 g/m$^2$, and the raw paper (base paper) having a thickness of 160 μm was obtained.

The wire side (back side) of the base paper obtained was subjected to corona discharge treatment, and thereto a resin composition, in which a high-density polyethylene having an MFR (which stands for a melt flow rate, and hereinafter has the same meaning) of 16.0 g/10 min and a density of 0.96 g/cm$^3$ (containing 250 ppm of hydrotalcite (DHT-4A (trade name), manufactured by Kyowa Chemical Industry Cop., Ltd.) and 200 ppm of a secondary oxidation inhibitor (tris(2, 4-di-t-butylphenyl)phosphite, Irugaphos 168 (trade name), manufactured by Ciba Specialty Chemicals)) and a low-density polyethylene having an MFR of 4.0 g/10 min and a density of 0.93 g/cm$^3$ were mixed at a ratio of 75 to 25 by mass, was applied so as to have a thickness of 21 g/m$^2$, by means of a melt extruder, thereby forming a thermoplastic resin layer with a mat surface. (The side to which this thermoplastic resin layer was provided is hereinafter referred to as "back side"). The thermoplastic resin layer at the back side was further subjected to corona discharge treatment, and then coated with a dispersion prepared by dispersing into water a 1:2 mixture (by mass) of aluminum oxide (ALUMINASOL 100, trade name, manufactured by Nissan Chemical Industries, Ltd.) and silicon dioxide (SNOWTEX O, trade name, manufactured by Nissan Chemical Industries, Ltd.), as an antistatic agent, so that the coating had a dry mass of 0.2 g/m$^2$. Subsequently, the front surface (front side) of the base paper was subjected to corona discharge treatment, and then coated with 27 g/m$^2$ of a low-density polyethylene having an MFR of 4.0 g/10 min and a density of 0.93 g/m$^2$ and containing 10 mass % of titanium oxide, by means of a melt extruder, thereby forming a thermoplastic resin layer with a specular surface, to provide Support A.

(Preparation of Emulsion Dispersion A)

Were mixed 13.5 g of a high-boiling solvent (SOLV-5 set forth below), 19 g of EB-9 set forth below, 9 g of (B-47) set forth below and 20 ml of ethyl acetate. The thus-obtained solution was emulsified and dispersed in 250 g of a 20 mass % gelatin aqueous solution containing 1 g of sodium dodecylbenzene sulfonate using a high speed stirring emulsifier (Dissolver), followed by addition of water, thereby to prepare 380 g of an emulsion A.

SOLV-5

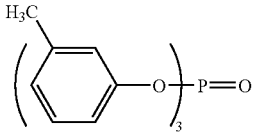

EB-9

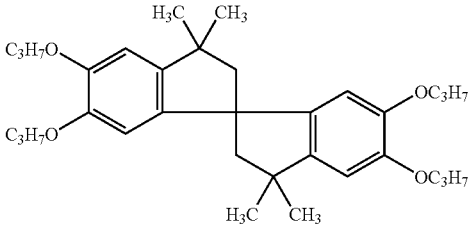

(B-47)

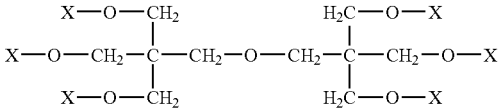

A mixture in which, among 6 X's, 3 X's were —$CO(CH_2)_5OCOCH{=}CH_2$, and each of the remaining 3 X's was —$OCOCH{=}CH_2$ (Preparation of Heat-Sensitive Transfer Image-Receiving Sheet 11

On the support A prepared as described above, there were coated a coating solution for an interlayer having the composition set forth below and a coating solution for a receptor layer 1 having the composition set forth below in an order from a lower layer, so that the thickness of each of the interlayer and the receptor layer after drying would become 15 μm and 4 μm, respectively. The polymer used in the interlayer and the coating method are described in Table 3 below.

<Coating Solution for Interlayer>

| | |
|---|---|
| Hollow polymer latex (MH5055 (trade name), manufactured by Nippon Zeon Co., Ltd.) (water dispersion of hollow-structure polymer particles having an outside diameter of 0.5 μm) | 150 mass parts |
| 10% Gelatin aqueous solution | 50 mass parts |
| The above-described emulsion A | 60 mass parts |
| Compound X (crosslinking agent) | 2 mass parts |
| NaOH | Amount necessary to make pH 8 |

Compound X

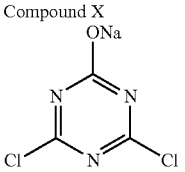

<Coating Solution for Receptor Layer 1>

| | |
|---|---|
| Polycarbonate resin (Trade name: LEXAN-141, manufactured by General Electric Corporation) | 30 mass parts |
| Polyester resin (Trade name: Vylon 200, manufactured by Toyobo Co., Ltd.) | 70 mass parts |

-continued

| | |
|---|---|
| Amino-modified silicone (Trade name: X22-3050C, manufactured by Shin-Etsu Chemical Co., Ltd.) | 5 mass parts |
| Epoxy-modified silicone (Trade name: X22-300E, manufactured by Shin-Etsu Chemical Co., Ltd.) | 5 mass parts |
| Methylene chloride | 400 mass parts |

(Preparation of Heat-Sensitive Transfer Image-Receiving Sheet 12)

As a support B, there was used a synthetic paper (trade name: yupo FPG200, thickness 200 μm, manufactured by yupo corporation). On one side of the support, a coating solution for white interlayer having the composition set forth below was coated with a bar coater, and then the above-described coating solution for a receptor layer 1 was coated on the thus-formed white interlayer. The coating was performed so that the coating amounts after dry of the white interlayer and the receptor layer would be 1.0 g/m$^2$ and 4.0 g/m$^2$, respectively. Drying of each layer was conducted at 110° C. for 30 seconds.

<Coating Solution for White Interlayer>

| | |
|---|---|
| Polyester resin (Trade name: Vylon 200, manufactured by Toyobo Co., Ltd.) | 10 mass parts |
| Fluuorescent whitening agent (Trade name: Uvitex OB, manufactured by Ciba Specialty Chemicals) | 1 mass part |
| Titanium oxide | 30 mass parts |
| Methyl ethyl ketone/toluene (=1/1, at mass ratio) | 90 mass parts |

(Preparation of Heat-Sensitive Transfer Image-Receiving Sheet 13)

A heat-sensitive transfer image-receiving sheet 13 was prepared in the same manner as that of the heat-sensitive transfer image-receiving sheet 12, except that the composition of the coating solution for the receptor layer was changed as described below.

<Coating Solution for Receptor Layer>

| | |
|---|---|
| Fluorine-series surface active agent (Trade name: Fluorad FC-170C, manufactured by 3M Corporation) | 1 mass part |
| Polyvinyl alcohol (Trade name: PVA-105, manufactured by Kuraray Co., Ltd.) | 150 mass parts |
| Distilled water | 1,000 mass parts |

Example 1

Image Recording and Evaluation

Each of the heat-sensitive transfer sheets 1 to 8 prepared in Production Example 1 and each of the heat-sensitive transfer image-receiving sheets 11 to 13 prepared in Production Example 2 were superposed so that the receptor layer of the heat-sensitive transfer image-receiving sheet could be contacted with the thermal transfer layer of the heat-sensitive transfer sheet. Printing was performed using a thermal head on the back side of the heat-sensitive transfer sheet under the conditions of 0.25 W/dot of output of the thermal head, 0.15 to 15 msec. of pulse width, and 6 dots per $mm^2$ of dot density. Thus, dyes were dyed to the receptor layer of the heat-sensitive transfer image-receiving sheet so that each monochrome and gray could be made.

Spectral absorbance of the heat-sensitive transfer sheets used for the printing described above was measured before and after the transferring, to evaluate the transfer rate. The transfer rate was evaluated at the maximum absorption wavelength according to the following formula:

(Transfer rate)={(Absorbance of the heat-sensitive transfer sheet before transfer)−(Absorbance of the heat-sensitive transfer sheet after transfer)}/(Absorbance of heat-sensitive transfer sheet before transfer)×100.

Each of the transfer rates was shown in Table 3.

TABLE 3

| | Image-receiving sheet | | |
|---|---|---|---|
| | Heat-sensitive transfer image-receiving sheet 11 | Heat-sensitive transfer image-receiving sheet 12 | Heat-sensitive transfer image-receiving sheet 13 |
| | Receptor layer | | |
| | Polyester and polycarbonate polymers | Polyester and polycarbonate polymers | Polyvinyl alcohol-series polymer |
| | Interlayer | | |
| Thermal transfer | Hollow polymer particles were contained. | No hollow polymer particle was contained. | No hollow polymer particle was contained. |
| | Support | | |
| sheet | Support A | Support B (Synthetic paper) | Support A |
| 1 (This invention) | 55 (This invention) | 52 (This invention) | 18 (Comparative example) |
| 2 (This invention) | 58 (This invention) | 53 (This invention) | 21 (Comparative example) |
| 3 (This invention) | 51 (This invention) | 50 (This invention) | 17 (Comparative example) |
| 4 (This invention) | 46 (This invention) | 43 (This invention) | 14 (Comparative example) |
| 5 (This invention) | 54 (This invention) | 51 (This invention) | 19 (Comparative example) |
| 6 (This invention) | 54 (This invention) | 52 (This invention) | 20 (Comparative example) |
| 7 (This invention) | 51 (This invention) | 50 (This invention) | 16 (Comparative example) |
| 8 (Comparative example) | 38 (Comparative example) | 36 (Comparative example) | 10 (Comparative example) |

From the results shown in Table 3, it is substantiated that the dye transfer rate was high, when the imaging was conducted by a combination of the heat-sensitive transfer sheet containing a dye having a structure represented by formula (1) or (2) and the heat-sensitive transfer image-receiving sheet having a receptor layer containing polyester and/or polycarbonate polymers. It was also recognized that the dye transfer rate was particularly high when the heat-sensitive transfer image-receiving sheet having an interlayer containing hollow particles (hollow polymer particles) was used.

Production Example 3

Preparation of Heat-Sensitive Transfer Image-Receiving Sheets 21 to 23)

(Preparation of Emulsion Dispersion B)

Were mixed 11.0 g of a high-boiling solvent (SOLV-5 described above), 9 g of KF-96 (manufactured by Shin-Etsu Chemical Co., Ltd.), 15.5 g of EB-9 described above, 7.5 g of (B-47) described above and 20 ml of ethyl acetate. The thus-obtained solution was emulsified and dispersed in 250 g of a 20 mass % gelatin aqueous solution containing 1 g of sodium dodecylbenzene sulfonate using a high speed stirring emulsifier (Dissolver), followed by addition of water, thereby to prepare 380 g of an emulsion B.

(Production of Heat-Sensitive Transfer Image-Receiving Sheet 21)

A heat-sensitive transfer image-receiving sheet 21 was produced in the same manner as in the production of the heat-sensitive transfer image-receiving sheet 11, except that the following coating solution for the receptor layer 2 was used in place of the coating solution for the receptor layer 1.

<Coating Solution for the Receptor Layer 2>

| | |
|---|---|
| Vinyl chloride/vinyl acetate resin (Trade name: Solbin A, manufactured by Nisshin Chemicals Co., Ltd.) | 100 mass parts |
| Amino-modified silicone (Trade name: X22-3050C, manufactured by Shin-Etsu Chemical Co., Ltd.) | 5 mass parts |
| Epoxy-modified silicone | 5 mass parts |

-continued

| | |
|---|---|
| (Trade name: X22-300E, manufactured by Shin-Etsu Chemical Co., Ltd.) | |
| Methyl ethyl ketone/toluene (= 1/1, at mass ratio) | 400 mass parts |

(Production of Heat-Sensitive Transfer Image-Receiving Sheet 22)

A heat-sensitive transfer image-receiving sheet 22 was produced in the same manner as in the production of the heat-sensitive transfer image-receiving sheet 12, except that the above-described coating solution for the receptor layer 2 was used in place of the coating solution for the receptor layer 1.

(Production of Heat-Sensitive Transfer Image-Receiving Sheet 23)

A heat-sensitive transfer image-receiving sheet 23 was produced in the same manner as in the production of the heat-sensitive transfer image-receiving sheet 11, except that the following coating solution for the receptor layer 3 was used in place of the coating solution for the receptor layer 1.

<Coating Solution for the Receptor Layer 3>

| | |
|---|---|
| Vinyl chloride polymer latex (Trade name: VINYBLAN 900, manufactured by Nissin Chemical Industry Co., Ltd.) | 50 mass parts |
| Vinyl chloride polymer latex (Trade name: VINYBLAN 276 revised-1, manufactured by Nissin Chemical Industry Co., Ltd.) | 10 mass parts |
| Emulsion dispersion B set forth above | 3.5 mass parts |
| Microcrystalline wax (Trade name: EMUSTAR-042X, manufactured by Nippon Seiro Co., Ltd.) | 5 mass parts |
| Compound X | 0.1 mass part |
| Water | 8 mass parts |
| NaOH | Amount necessary to make pH 8 |

Example 2

Image Recording and Evaluation

Each of the heat-sensitive transfer sheets 1 to 8 prepared in Production Example 1 and each of the heat-sensitive transfer image-receiving sheets 21 to 23 prepared in Production Example 3 were superposed so that the receptor layer of the heat-sensitive transfer image-receiving sheet could be contacted with the thermal transfer layer of the heat-sensitive transfer sheet. The same test as for Example 1 was performed using these sheets, to evaluate the transfer rate. Each of the transfer rate is shown in Table 4.

TABLE 4

| | Image receiving sheet | | |
|---|---|---|---|
| | Heat-sensitive transfer image-receiving sheet 21 | Heat-sensitive transfer image-receiving sheet 22 | Heat-sensitive transfer image-receiving sheet 23 |
| | Receptor layer | | |
| | Vinyl chloride polymers | Vinyl chloride polymers | Vinyl chloride polymer latex |
| | Interlayer | | |
| Thermal transfer | Hollow polymer particles were contained. | No hollow polymer particle was contained. | Hollow polymer particles were contained. |
| | Support | | |
| sheet | Support A | Support B (Synthetic paper) | Support A |
| 1 (This invention) | 54 (This invention) | 52 (This invention) | 56 (This invention) |
| 1 (This invention) | 54 (This invention) | 52 (This invention) | 56 (This invention) |
| 2 (This invention) | 56 (This invention) | 53 (This invention) | 57 (This invention) |
| 3 (This invention) | 50 (This invention) | 47 (This invention) | 52 (This invention) |
| 4 (This invention) | 44 (This invention) | 41 (This invention) | 46 (This invention) |
| 5 (This invention) | 52 (This invention) | 50 (This invention) | 54 (This invention) |
| 6 (This invention) | 50 (This invention) | 47 (This invention) | 52 (This invention) |
| 7 (This invention) | 50 (This invention) | 47 (This invention) | 51 (This invention) |
| 8 (Comparative example) | 36 (Comparative example) | 33 (Comparative example) | 37 (Comparative example) |

From the results shown in Table 4, it is substantiated that the dye transfer rate was high, when the imaging was conducted by a combination of the heat-sensitive transfer sheet containing a dye having a structure represented by formula (1) or (2) and the heat-sensitive transfer image-receiving sheet having a receptor layer containing vinyl chloride polymers. It was also recognized that the dye transfer rate was particularly high when the heat-sensitive transfer image-receiving sheet having 1) a interlayer containing hollow particles and 2) a receptor layer containing a polymer latex, was used.

Having described our invention as related to the present embodiments, it is our intention that the invention not be limited by any of the details of the description, unless otherwise specified, but rather be construed broadly within its spirit and scope as set out in the accompanying claims.

What we claim is:

1. An image-forming method comprising the steps of:

superposing a heat-sensitive transfer sheet on a heat-sensitive transfer image-receiving sheet so that at least one receptor layer of the heat-sensitive transfer image-receiving sheet can be contacted with a thermal transfer layer of the heat-sensitive transfer sheet described below; and providing thermal energy in accordance with image signals given from a thermal head, thereby to form an image;

(i) wherein the heat-sensitive transfer image-receiving sheet comprises, on a support, at least one receptor layer that contains at least one polymer latex selected from the group consisting of a polymer latex of a polyvinyl chloride and a polymer latex of a copolymer comprising a monomer unit of vinyl chloride; and (ii) wherein the heat-sensitive transfer sheet comprises, on a support, a thermal transfer layer that contains at least one dye selected from the group consisting of dyes represented by formula (1):

Formula (1)

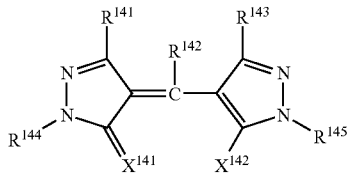

wherein, $X^{141}$ represents an oxygen atom, a sulfur atom, or $NR^{146}$; $X^{142}$ represents a hydroxyl group, a mercapto group, or $NHR^{147}$; and $R^{141}$, $R^{142}$, $R^{143}$, $R^{144}$, $R^{145}$, $R^{146}$ and $R^{147}$ each independently represent a hydrogen atom or a monovalent substituent; and wherein the heat-sensitive transfer image-receiving sheet has an interlayer containing hollow particles between the support and the receptor layer.

2. The image-forming method according to claim 1, wherein the interlayer of the heat-sensitive transfer image-receiving sheet contains a water-soluble polymer.

3. The image-forming method according to claim 1, wherein, in formula (1), $X^{141}$ is an oxygen atom, $X^{142}$ is a hydroxyl group, $R^{141}$ and $R^{143}$ each are a substituted or unsubstituted alkyl group having 1 to 6 carbon atoms, $R^{142}$ is a hydrogen atom, and $R^{144}$ and $R^{145}$ each are a substituted or unsubstituted aryl group.

4. The image-forming method according to claim 1, wherein the molecular weight of the dye represented by formula (1) is 450 or less.

5. The image-forming method according to claim 1, wherein the receptor layer contains at least two polymer latexes selected from the group consisting of a polymer latex of a polyvinyl chloride and a polymer latex of a copolymer comprising a monomer unit of vinyl chloride.

6. The image-forming method according to claim 1, wherein the receptor layer further contains a polyvinyl alcohol or a gelatin.

7. The image-forming method according to claim 1, wherein the receptor layer contains a polymer crosslinked with a crosslinking agent.

8. The image-forming method according to claim 1, wherein the interlayer of the heat-sensitive transfer image-receiving sheet functions as a heat insulation layer and contains gelatin.

9. The image-forming method according to claim 1, wherein the water soluble polymer is a water-soluble polymer crosslinked with a crosslinking agent.

10. The image-forming method according to claim 1, wherein the particle size of the hollow particles is 0.1 to 1 μm.

11. The image-forming method according to claim 1, wherein the glass transition temperature of the hollow particles is 100° C. or more.

12. The image-forming method according to claim 1, wherein the hollow particles have a hollow ratio of from 20% to 70%.

13. The image-forming method according to claim 1, wherein the solid content of the hollow particles is 50% by mass or more, based on the total solid content of the hollow particles and a binder resin in the interlayer functioning as a heat insulation layer.

14. The image-forming method according to claim 1, wherein the polymer latex contained in the receptor layer is a polymer latex of a copolymer of vinyl chloride and an acrylic ester.

15. An image-forming method comprising the steps of:

superposing a heat-sensitive transfer sheet on a heat-sensitive transfer image-receiving sheet so that at least one receptor layer of the heat-sensitive transfer image-receiving sheet can be contacted with a thermal transfer layer of the heat-sensitive transfer sheet described below; and providing thermal energy in accordance with image signals given from a thermal head, thereby to form an image;

(i) wherein the heat-sensitive transfer image-receiving sheet comprises, on a support, at least one receptor layer that contains at least one polymer latex selected from the group consisting of a polymer latex of a polyvinyl chloride or a polymer latex of a copolymer comprising a monomer unit of vinyl chloride; and (ii) wherein the heat-sensitive transfer sheet comprises, on a support, a thermal transfer layer that contains at least one dye selected from the group consisting of dyes represented by formula (2):

Formula (2)

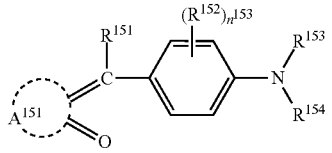

wherein, in formula (2), $R^{151}$, $R^{153}$ and $R^{154}$ each independently represent a hydrogen atom or a monovalent substituent; $R^{152}$ represents a monovalent substituent; $A^{151}$ represents a group of atoms necessary to form a hetero ring together with the two carbon atoms; and $n^{153}$ represents an integer of 0 to 4; and wherein the heat-sensitive transfer image-receiving sheet has an interlayer containing hollow particles between the support and the receptor layer.

16. The image-forming method according to claim 15, wherein the receptor layer contains at least two polymer latexes selected from the group consisting of a polymer latex of a polyvinyl chloride and a polymer latex of a copolymer comprising a monomer unit of vinyl chloride.

17. The image-forming method according to claim 15, wherein the receptor layer further contains a polyvinyl alcohol or a gelatin.

18. The image-forming method according to claim 15, wherein the receptor layer contains a polymer crosslinked with a crosslinking agent.

19. The image-forming method according to claim 15, wherein the interlayer of the heat-sensitive transfer image-receiving sheet functions as a heat insulation layer and contains gelatin.

20. The image-forming method according to claim 15, wherein the water soluble polymer is a water-soluble polymer crosslinked with a crosslinking agent.

21. The image-forming method according to claim 15, wherein the particle size of the hollow particles is 0.1 to 1 μm.

22. The image-forming method according to claim 15, wherein the glass transition temperature of the hollow particles is 100° C. or more.

23. The image-forming method according to claim 15, wherein the hollow particles have a hollow ratio of from 20% to 70%.

24. The image-forming method according to claim 15, wherein the solid content of the hollow particles is 50% by mass or more, based on the total solid content of the hollow particles and a binder resin in the interlayer functioning as a heat insulation layer.

25. The image-forming method according to claim 15, wherein the polymer latex contained in the receptor layer is a polymer latex of a copolymer of vinyl chloride and an acrylic ester.

* * * * *